US009193156B2

(12) United States Patent
Otsuka et al.

(10) Patent No.: US 9,193,156 B2
(45) **Date of Patent: *Nov. 24, 2015**

(54) CAPACITIVE LOAD DRIVE CIRCUIT

(71) Applicant: Seiko Epson Corporation, Tokyo (JP)

(72) Inventors: Shuji Otsuka, Shiojiri (JP); Tadashi Kiyuna, Hachioji (JP); Toshifumi Asanuma, Hamura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/540,133

(22) Filed: Nov. 13, 2014

(65) Prior Publication Data

US 2015/0070424 A1 Mar. 12, 2015

Related U.S. Application Data

(63) Continuation of application No. 14/212,464, filed on Mar. 14, 2014, now Pat. No. 8,915,578.

(30) Foreign Application Priority Data

Mar. 22, 2013 (JP) ..... 2013-059207

(51) Int. Cl.
*B41J 2/14* (2006.01)
*B41J 2/045* (2006.01)

(52) U.S. Cl.
CPC ..... *B41J 2/04541* (2013.01); *B41J 2/0455* (2013.01); *B41J 2/0457* (2013.01); *B41J 2/04548* (2013.01); *B41J 2/04581* (2013.01); *B41J 2/14233* (2013.01)

(58) Field of Classification Search
CPC .. B41J 2/142; B41J 2002/14491; B41J 2/045; B41J 2202/11; B41J 2202/18
See application file for complete search history.

(56) References Cited

U.S. PATENT DOCUMENTS

| | | | | |
|---|---|---|---|---|
| 6,334,668 | B1 | 1/2002 | Isamoto | |
| 7,735,967 | B2 | 6/2010 | Takenaka et al. | |
| 8,523,330 | B2 | 9/2013 | Ueno | |
| 8,529,022 | B2 | 9/2013 | Sabanovic et al. | |
| 8,915,578 | B2 * | 12/2014 | Otsuka et al. | 347/68 |

FOREIGN PATENT DOCUMENTS

JP 2000-343690 A 12/2000

* cited by examiner

*Primary Examiner* — Lamson Nguyen

(57) ABSTRACT

A capacitive load drive circuit, which may be embodied in a printer, includes a movable member; pressure chambers and respective capacitive elements; a first circuit substrate installed outside the movable member, and on which is installed a control signal supply unit that generates control signals; a second circuit substrate installed on the movable member, and on which is installed a circuit that charges or discharges the capacitive elements according to the control signals; and a flexible flat cable, on which is formed wirings including control wiring, which transmits the control signals from the first to the second circuit substrate, and a wiring, which supplies power supply and ground voltages to the second circuit substrate. A total path length of the wirings between the first and second circuit substrates is shorter than the total path length of the wiring between the second circuit substrate and each of the capacitive elements.

6 Claims, 16 Drawing Sheets

<FIRST STATE: CHARGING>

<SECOND STATE: CHARGING>

<SECOND STATE: DISCHARGING>

<FIRST STATE: DISCHARGING>

<STATE A (TERMINAL a SELECTION)>

<STATE B (TERMINAL b SELECTION)>

CAPACITIVE LOAD DRIVE CIRCUIT

CROSS-REFERENCE TO RELATED APPLICATION(S)

This application is a continuation of, and claims priority under 35 U.S.C. §120 on, U.S. application Ser. No. 14/212,464, filed Mar. 14, 2014, which claims priority to Japanese Patent Application No. 2013-059207, filed on Mar. 22, 2013. The content of each related application is incorporated by reference herein in its entirety.

BACKGROUND

1. Technical Field

The present invention relates to driving a load with a capacitive element, which can be applied to printing technology in which liquid droplets are discharged onto a recording medium.

2. Related Art

In the related art, a serial-type printing apparatus is proposed which discharges ink droplets onto a recording medium from a plurality of nozzles of a print head while causing a carriage, on which the print head is mounted, to move reciprocally in an intra-surface direction of the recording medium such as paper (for example, refer to JP-A-2000-343690). A control unit that is installed on a housing of the printing apparatus and the print head on the carriage are electrically connected via a flexible flat cable (hereinafter referred to as an FFC).

An electronic circuit, which generates a control signal of a predetermined waveform, is installed in the control unit that is outside of the carriage. The control signal is supplied to the print head from the control unit via the FFC. A plurality of piezoelectric elements, which discharge the ink droplets from the nozzles by deforming according to the supply of a control signal, and a plurality of switches, which control the supply and cut-off of the control signals supplied from the control unit for each of the piezoelectric elements, are installed in the print head on the carriage.

However, in order to supply a control signal of an appropriate waveform to each of the piezoelectric elements even when the number of the piezoelectric elements that are supplied with the control signal in parallel is great (when the drive load is great), it is necessary to supply a control signal with an extremely large current to the print head from the control unit via the FFC. Therefore, the power loss on the FFC is great and the waveform of the control signal is not stable. As a result, there is a problem in that the print quality is reduced. In a Large Format Printer (LFP), in which the movement amount of the carriage is great, since the total length of the FFC can reach several meters, the power loss on the FFC becomes prominent and the reduction in the print quality becomes particularly serious.

SUMMARY

An advantage of some aspects of the invention is that a reduction in the print quality caused by power loss on the FFC is suppressed.

According to an aspect of the invention, there is provided a capacitive load drive circuit, which may be embodied in a printing apparatus that discharges liquid droplets onto a recording medium. Such circuit includes a movable member; pressure chambers and respective capacitive elements; a first circuit substrate, which is installed outside of the movable member, and on which is installed a control signal supply unit that generates control signals; a second circuit substrate, which is installed on the movable member, and on which is installed a circuit that charges or discharges each of the capacitive elements according to the control signals; and a flexible flat cable (an FFC), on which is formed a plurality of wirings including control wiring, which transmits the control signals from the first circuit substrate to the second circuit substrate, and a wiring, which supplies a power supply voltage and a ground voltage to the second circuit substrate. A total path length of the plurality of wirings between the first circuit substrate and the second circuit substrate is shorter than the total path length of the wiring between the second circuit substrate and each of the capacitive elements.

In a printing apparatus embodiment, such apparatus includes discharging units, which are installed on a carriage, which serves as the movable member, and further includes nozzles, in communication with the pressure chambers, that discharge a liquid. Piezoelectric elements may serve as the capacitive elements.

In the configuration described above, the total path length of the plurality of wirings of the wiring substrate spanning the first circuit substrate and the second circuit substrate is shorter than the total path length of the wiring between the second circuit substrate and each of the capacitive elements; thus, in comparison to a configuration in which the total path length of the prior is longer than the total path length of the latter, the power loss on the wiring substrate is reduced, and it is possible to suppress the reduction in the print quality.

In a favorable aspect of the invention, a booster circuit that generates a plurality of voltages, and connection path selecting units that selectively supply the plurality of voltages generated by the booster circuit to the capacitive elements according to the control signals may be installed on the second circuit substrate. In the configuration described above, the booster circuit and the connection path selecting units are installed on the second circuit substrate on the movable member; thus, in comparison to a configuration in which the booster circuit and the connection path selecting units are installed on the first circuit substrate, it is possible to suppress a reduction in the print quality caused by the power loss on the FFC. Note that the phrase "selectively supply the plurality of voltages . . . to the capacitive elements" means to select one of a plurality of voltages, and to supply the voltage to the capacitive element; specifically, this includes a configuration in which a plurality of wirings, to which different voltages are supplied from the booster circuit, are selectively electrically connected to the capacitive elements.

In a more favorable aspect of the invention, the connection path selecting units may electrically connect the capacitive elements and the booster circuit using a first signal path or a second signal path according to the first signal path, to which a first voltage generated by the booster circuit is applied, the second signal path, to which the second voltage generated by the booster circuit that is higher than the first voltage is applied, voltages of the control signals, and the voltages held by the capacitive elements. In the aspect described above, the capacitive elements and the booster circuit are electrically connected by the first signal path or the second signal path according to the voltages of the control signals and the voltages held by the capacitive elements. Accordingly, it is possible to increase the energy efficiency in comparison to a configuration of the related art in which the charges of the capacitive elements are charged and discharged at once between the power supply voltages. There is also a merit in that it is possible to suppress EMI in comparison with D class amplification that switches a large current.

The capacitive load drive circuit according to a favorable aspect of the invention may further include detection units, which are installed on the second circuit substrate, and detect whether or not the voltages held by the capacitive elements are lower than the first voltage, or, whether or not the voltages held by the capacitive elements are equal to or higher than the first voltage and lower than the second voltage. In the aspect described above, it is detected whether or not the voltages maintained by the capacitive elements are lower than the first voltage, and whether or not the voltages are equal to or higher than the first voltage and lower than the second voltage. Note that, in the detection unit, a portion that detects whether or not the voltage held by the capacitive element is lower than the first voltage, and a portion that detects whether or not the voltage held by the capacitive element is equal to or higher than the first voltage and lower than the second voltage may be installed separately or integrally.

In a favorable aspect of the invention, in relation to the capacitive elements holding a voltage that is lower than the first voltage, the connection path selecting units may control charges to be charged to the capacitive elements via the first signal path according to the voltages of the control signals, and, in relation to the capacitive elements holding a voltage that is equal to or higher than the first voltage and lower than the second voltage, the connection path selecting units may control the charges to be discharged from the capacitive elements via the first signal path, or, may control the charges to be charged to the capacitive elements via the second signal path according to the voltages of the control signals. In the aspect described above, the path of the charge that is charged to or discharged from the capacitive element is controlled according to the voltage of the control signal.

The capacitive load drive circuit according to a favorable aspect of the invention may include a first transistor, a second transistor, and a third transistor, in which, in relation to the capacitive element holding a voltage that is lower than the first voltage, the first transistor may control a charge to be charged to the capacitive element via the first signal path according to a voltage that is obtained by shifting the voltage of the control signal to a low potential side by a predetermined value, and in which, in relation to the capacitive element holding a voltage that is equal to or higher than the first voltage and lower than the second voltage, the second transistor may control a charge to be discharged from the capacitive element via the first signal path according to a voltage that is obtained by shifting the voltage of the control signal to a high potential side by a predetermined value, and the third transistor may control a charge to be charged to the capacitive element via the second signal path according to a voltage that is obtained by shifting the voltage of the control signal to the low potential side by a predetermined value. Note that, in the aspect described above, the predetermined value described above may be set to zero if the first transistor, the second transistor, and the third transistor are ideal; however, if bipolar transistors are used, for example, the predetermined value is set to a voltage that is equivalent to the bias voltage. For example, if a Metal-Oxide Semiconductor Field-Effect Transistor (a MOSFET) is used, the predetermined value may be set to a voltage that is equivalent to the threshold voltage.

In a favorable aspect of the invention, if the voltage held by the capacitive element is not lower than the first voltage, the first transistor turns off, and if the voltage is not equal to or higher than the first voltage and lower than the second voltage, the second transistor and the third transistor turn off. In the aspect described above, if the voltage held by the capacitive element is not lower than the first voltage, the first transistor turns off; thus, the capacitive element is electrically isolated from the first signal path. If the voltage held by the capacitive element is not equal to or higher than the first voltage or lower than the second voltage, the second transistor and the third transistor turn off; thus the capacitive element is electrically isolated from the second signal path.

A configuration may also be adopted in which the charge to be charged to the capacitive element or the charge to be discharged from the capacitive element is controlled using a voltage, which is obtained by subtracting a voltage that corresponds to the capacitive element from the voltage of the control signal and multiplying the resulting voltage a predetermined number of times. In the aspect described above, it is possible to cause the voltage held by the capacitive element to follow a voltage that corresponds to the control signal in a highly precise and quick manner by using negative feedback control.

In a printing apparatus (a serial printer) in which the carriage may move in a main scanning direction, which intersects a sub-scanning direction in which a recording medium is transported, it is necessary to secure a sufficient length for the FFC; thus, there is in issue in that a reduction in the print quality caused by power loss on the FFC is likely to manifest. The invention, which can suppress the reduction in the print quality caused by power loss on the FFC, is especially effective in a printing apparatus of a configuration in which the carriage moves in the main scanning direction (in other words, a configuration in which it is necessary to secure a sufficient length for the FFC).

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
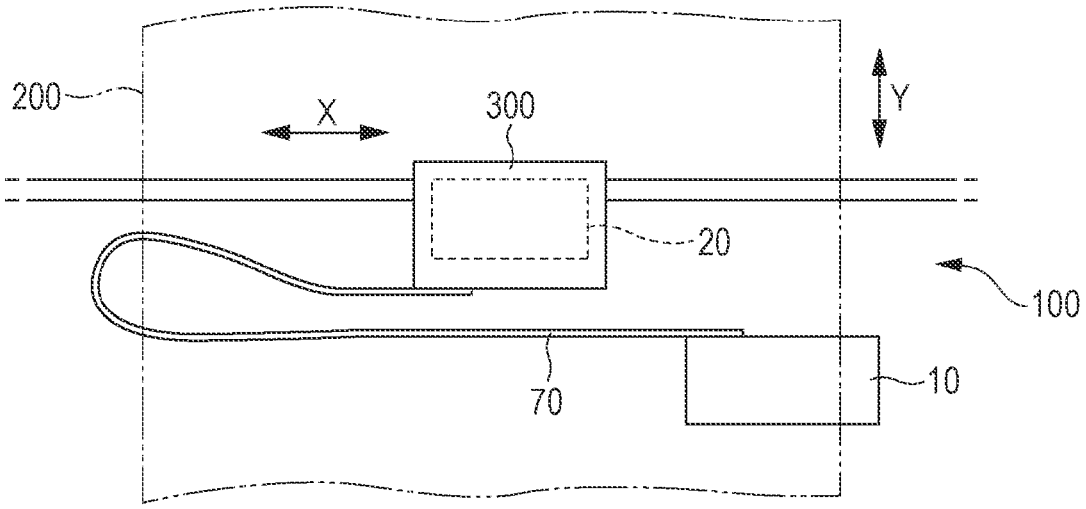
FIG. 1 is a schematic view showing a portion of the structure of a printing apparatus according to one of the embodiments of the invention.

FIG. 1 is a schematic view showing a portion of a printing apparatus 100 of an ink jet type according to one of the embodiments of the invention. The printing apparatus 100 of this embodiment is a liquid discharging apparatus that discharges liquid droplets of an ink (hereinafter referred to as ink droplets) onto a recording medium 200 such as printing paper. The recording medium 200 is transported in a sub-scanning direction Y by a transporting mechanism (not shown). The printing apparatus 100 of this embodiment is a serial printer that includes a movable carriage 300. Specifically, the carriage 300 moves in a main scanning direction X, which intersects the sub-scanning direction Y in which the recording medium 200 is transported. In addition to a configuration in which a cartridge (not shown) that accommodates a liquid ink is installed on the carriage 300 (on-carriage), a configuration may also be adopted in which the ink is supplied to the carriage 300 from a cartridge installed outside of the carriage 300 (off-carriage) via a flow path.

Figure 2:
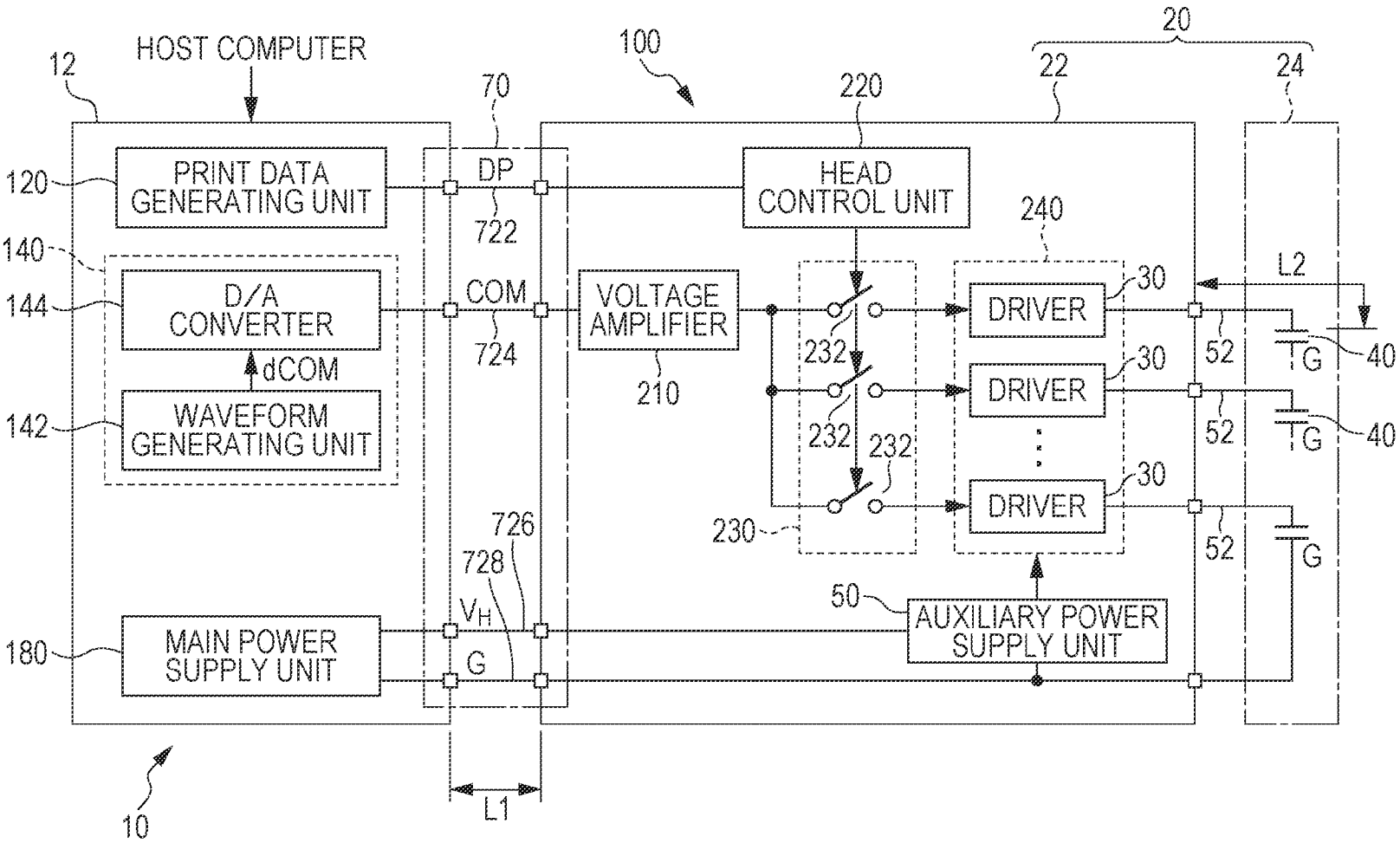
FIG. 2 is a block diagram showing an electrical configuration of the printing apparatus.

FIG. 2 is a block diagram showing the electrical configuration of the printing apparatus 100. As shown in FIGS. 1 and 2, the printing apparatus 100 includes a control unit 10, a print head 20 and a Flexible Flat Cable (FFC) 70. The control unit 10 is installed outside of the carriage 300 (for example, on the housing of the printing apparatus 100), and the print head 20 is installed on the carriage 300 and moved in the main scanning direction X. The FFC 70 is a flexible wiring substrate on which a plurality of wirings 72 (722, 724, 726, and 728), which electrically connect the control unit 10 and the print head 20 together, is formed. In addition, the FFC 70 deforms together with the movement of the carriage 300 (the print head 20).

The control unit 10 is an element that executes a computation process and a control process for printing an image specified by image data supplied from a host computer and includes the control substrate 12 (the first circuit substrate) of FIG. 2. A print data generating unit 120, a control signal supply unit 140 and a main power supply unit 180 are installed on the control substrate 12. Furthermore, the main power supply unit 180 can also be installed outside of the control substrate 12.

The main power supply unit 180 generates a power supply voltage $V_H$ and a ground voltage G, and supplies the generated voltages to each of the elements on the control substrate 12 and to the print head 20. The ground voltage G is equivalent to a voltage reference value (voltage zero), and the power supply voltage $V_H$ is the voltage of the high potential side of the ground voltage G. The power supply voltage $V_H$ is supplied to the print head 20 via the wiring 726 of the FFC 70, and the ground voltage G is supplied to the print head 20 via the wiring (hereinafter referred to as the "ground wiring") 728 of the FFC 70.

The print data generating unit 120 and the control signal supply unit 140 of FIG. 2 are, for example, realized by a computational processing apparatus (a CPU), which executes a program that is stored on a memory circuit such as RAM, or various logical circuits. Furthermore, an element that controls the transporting mechanism, which transports the recording medium 200 in the sub-scanning direction Y, or an element that controls the movement mechanism, which causes the carriage 300 to move in the main scanning direction X, can be installed on the control substrate 12. However, the illustration of such elements is omitted from FIG. 2 for convenience.

The print data generating unit 120 generates print data DP by executing various computational processes (for example, an image extraction process, a color conversion process, a color separation process, a half tone process and the like) in relation to the image data that is supplied from the host computer. The print data DP specifies the presence or absence of a discharge of ink droplets and the discharge amount of the ink droplets for each nozzle of the print head 20. The print data DP that is generated by the print data generating unit 120 is supplied to the print head 20 via the wiring 722 of the FFC 70.

The control signal supply unit 140 is an element that generates the control signal for causing the print head 20 to discharge ink droplets from each of the nozzles, and is configured to include a waveform generating unit 142 and a D/A converter 144. The waveform generating unit 142 generates a digital control signal dCOM that exhibits a predetermined waveform. The D/A converter 144 converts the control signal dCOM that is generated by the waveform generating unit 142 into an analogue control signal COM. The control signal COM that is generated by the control signal supply unit 140 is supplied to the print head 20 via the wiring (hereinafter referred to as the control wiring) 724 of the FFC 70.

The print head 20 is an element that discharges ink droplets from a plurality of nozzles under the control of the control unit 10, and includes a print head substrate 22 (the second circuit substrate) and a head module 24. A voltage amplifier 210, a head control unit 220, a selection unit 230, an element drive unit 240 and an auxiliary power supply unit 50 are installed on the print head substrate 22. Each of the elements on the print head substrate 22 is implemented on the print head substrate 22 in the form of being mounted on a single semiconductor integrated circuit (an IC chip), for example. However, it is also possible to mount the elements alternately on a plurality of separate semiconductor integrated circuits.

The head module 24 includes a plurality of piezoelectric elements (piezo elements) 40 that correspond to the distinct nozzles. Each of the piezoelectric elements 40 is a capacitive load disposed in a cavity (the ink chamber) into which the ink is supplied via the flow path. The piezoelectric elements 40 are deformed by charging and discharging and the volume of the cavity changes; therefore, the ink droplets are discharged from the nozzle that corresponds to the piezoelectric element 40.

Figure 3:
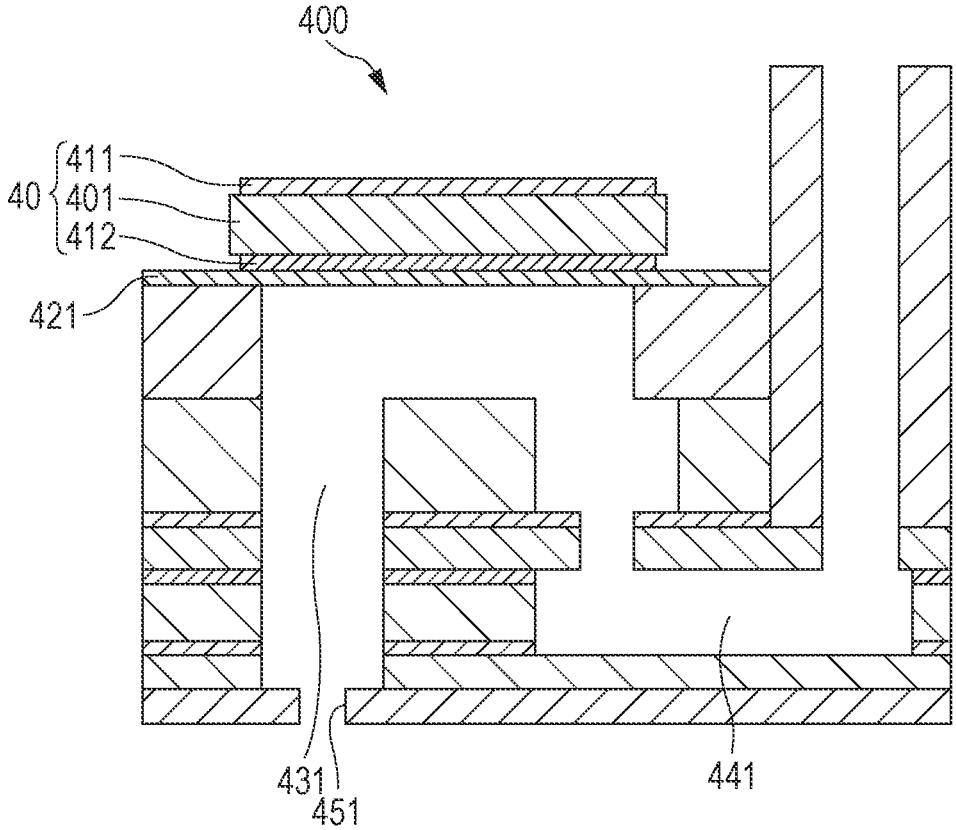
FIG. 3 is a view showing the main components of a discharging unit in a print head.

FIG. 3 is a view showing the schematic configuration of a discharging unit 400 that corresponds to one of the nozzles in the print head 20. As shown in FIG. 3, the discharging unit 400 includes the piezoelectric element 40, a vibration plate 421, a cavity (a pressure chamber) 431, a reservoir 441 and a nozzle 451. Of these, the vibration plate 421 is deformed by the piezoelectric element 40 that is provided on the upper surface thereof in FIG. 3; therefore causing the internal volume of the cavity 431, which is filled with the ink, to expand or contract. The nozzle 451 is an opening portion that communicates with the cavity 431.

The piezoelectric element 40 shown in FIG. 3 is generally referred to as unimorphic (monomorphic), and the structure thereof is formed from a piezoelectric body 401 interposed between a pair of electrodes 411 and 412. In the piezoelectric body 401 of this structure, corresponding to a voltage that is applied between the electrodes 411 and 412, in FIG. 3, the central portion of the piezoelectric body 401 flexes in the upward or downward direction in relation to both terminal portions thereof together with the electrodes 411 and 412, and the vibration plate 421. Here, if the piezoelectric body 401 flexes in the upward direction, since the internal volume of the cavity 431 expands, the ink is drawn in from the reservoir 441. However, if the piezoelectric body 401 flexes in the downward direction, since the internal volume of the cavity 431 contracts, the ink is discharged from the nozzle 451. Furthermore, the piezoelectric element 40 is not limited to being unimorphic, and may be of any type, such as bimorphic or laminated, that is capable of deforming the piezoelectric element and discharging a liquid such as the ink.

The element drive unit 240 on the print head substrate 22 is an element that drives the plurality of piezoelectric elements 40, and is configured to include a plurality of drivers 30, as shown in FIG. 2. Each of the drivers 30 of the element drive unit 240 corresponds one-for-one with each of the piezoelectric elements 40 of the head module 24. In other words, the print head 20 includes a plurality of sets, each of which includes one of the piezoelectric elements 40 and one of the drivers 30. A first terminal of each of the piezoelectric elements 40 is connected to an output terminal of the driver 30 that corresponds to the piezoelectric element 40 via the wiring 52, and the second terminals of the piezoelectric elements 40 are connected in common to the ground wiring 728 (the ground voltage G) of the FFC 70.

The voltage amplifier 210 of FIG. 2 amplifies the voltage of the control signal COM, which is supplied from the control signal supply unit 140 (the D/A converter 144) on the control substrate 12 via the control wiring 724 of the FFC 70. The selection unit 230 includes a plurality of switches 232. Each of the switches 232 corresponds one-for-one with each set that includes one of the drivers 30 of the element drive unit 240 and one of the piezoelectric elements 40 of the head module 24. After the control signal COM is amplified by the voltage amplifier 210, the first terminals of the switches 232 are supplied with the control signal COM in common, and the second terminal of each of the switches 232 is connected to an input terminal of the driver 30 that corresponds to the switch 232. Therefore, when one of the switches 232 is controlled to enter an ON state, the driver 30 of the subsequent stage of the switch 232 is supplied with the control signal COM. Conversely, when one of the switches 232 enters an OFF state, the supply of the control signal COM stops in relation to the driver 30 of the subsequent stage of the switch 232. The head control unit 220 of FIG. 2 controls each of the switches 232 of the selection unit 230 according to the print data DP that is supplied from the print data generating unit 120 on the control substrate 12 via the wiring 722 of the FFC 70. In other words, the selection unit 230 supplies the control signal COM, which is supplied from the control unit 10, to each of the drivers 30 that are selected according to the print data DP.

The auxiliary power supply unit 50 of FIG. 2 is a booster circuit, which generates a plurality of voltages from the voltage $V_H$ that is supplied from the main power supply unit 180 on the control substrate 12 via the wiring 726 of the FFC 70. Specifically, the auxiliary power supply unit 50 generates a 1/6 voltage, a 2/6 voltage, a 3/6 voltage, a 4/6 voltage, and a 5/6 voltage in relation to the voltage $V_H$ by using a charge pump circuit to perform voltage division and redistribution. The auxiliary power supply unit 50 then supplies the generated voltages together with the voltage $V_H$ to the plurality of drivers 30 in common. The driver 30 is a circuit (a connection path selecting unit), which drives (charges or discharges) the piezoelectric element 40 according to the control signal supplied from the selection unit 230 by using the plurality of power supply voltages that are supplied from the auxiliary power supply unit 50. Furthermore, a configuration may also be adopted in which each of the switches 232 of the selection unit 230 selects one of the control signals COM of a plurality of systems that are supplied to the print head 20 in parallel from the control substrate 12, and supplies the selected control signal COM to the driver 30 of the subsequent stage.

The path length L1 of FIG. 2 is the path length of each of the wirings 72 (722, 724, 726 and 728) that are used to electrically connect the control substrate 12 with the print head substrate 22 on the FFC 70. Specifically, the path length L1 is equivalent to the entire length of the path spanning from the terminal portions of the wiring 72 of the FFC 70, which are connected to the control substrate 12, to the terminal portions that are connected to the print head substrate 22. On the other hand, the path length L2 of FIG. 2 refers to the path length between the print head substrate 22 and the piezoelectric elements 40. Specifically, the path length L2 is equivalent to the entire length of the path spanning from the terminal portions that are connected to the print head substrate 22 of a wiring (a wiring pattern) 52, which connects the print head substrate 22 to the piezoelectric elements 40, to the terminal portions that are connected to the electrodes of the piezoelectric elements 40.

The total {N1×L1} of the path lengths L1 in relation to the plurality (N1 wires) of wirings 72 of the FFC 70 is shorter than the total {N2×L2} of the path lengths L2 in relation to the plurality (N2 wires) of wirings 52 (N1×L1<N2×L2). For example, when assuming that the printing apparatus 100, which can print onto the large format (for example, A2 size or bigger) recording medium 200, is used, for example, the wiring 72 is formed on the FFC 70 as 30 parallel wires spanning approximately 4 m (N1=30, L1=4). In addition, 8000 nozzles are formed on the print head 20, for example, and the piezoelectric elements 40 that correspond to each of the nozzles are electrically connected to the print head substrate 22 via approximately 0.1 m of the wiring 52 (N2=8000, L2=0.1). Therefore, the total (120 m) of the path lengths L1 spanning N1 wires of the wiring 72 is shorter than the total (800 m) of the path lengths L2 spanning N2 wires of the wiring 52. Furthermore, when the FFC 70 includes an excess portion, which is not actually used in the electrical connection between the control substrate 12 and the print head substrate 22, of the wiring 72, only the path lengths L1 of the wiring 72 (the wiring 72 excluding the excess portion thereof), which is actually used in the electrical connection between the control substrate 12 and the print head substrate 22, are added to the calculation of the total {N1×L1}.

A path length L1A from the semiconductor integrated circuit on the control substrate 12 to the semiconductor integrated circuit on the print head substrate 22, and a path length L2A from the semiconductor integrated circuit on the print head substrate 22 to the piezoelectric elements 40 are taken into consideration with a focus on the semiconductor integrated circuit, mounted on which is the control signal supply unit 140 (the D/A converter 144) on the control substrate 12, and the semiconductor integrated circuit on which is mounted each of the elements (the voltage amplifier 210, the selection unit 230, the head control unit 220, the element drive unit 240, and the auxiliary power supply unit 50) on the print head substrate 22. In the configuration described above, it is possible for the total {N1×L1A} of the path lengths L1A spanning N1 wires to be shorter than the total {N2×L2A} of the path lengths L2A spanning N2 wires.

As described above, in this embodiment, the total (N1×L1) of the path lengths L1 between the control substrate 12 and the print head substrate 22 is shorter than the total (N2×L2) of the path lengths L2 between the print head substrate 22 and the piezoelectric elements 40; therefore, the power loss on the FFC 70 is reduced in comparison to a configuration in which the total (N1×L1) of the path lengths L1 is longer than the total (N2×L2) of the path lengths L2. Therefore, it is possible to suppress a reduction in the print quality caused by the power loss on the FFC 70.

Driver 30

Figure 4:
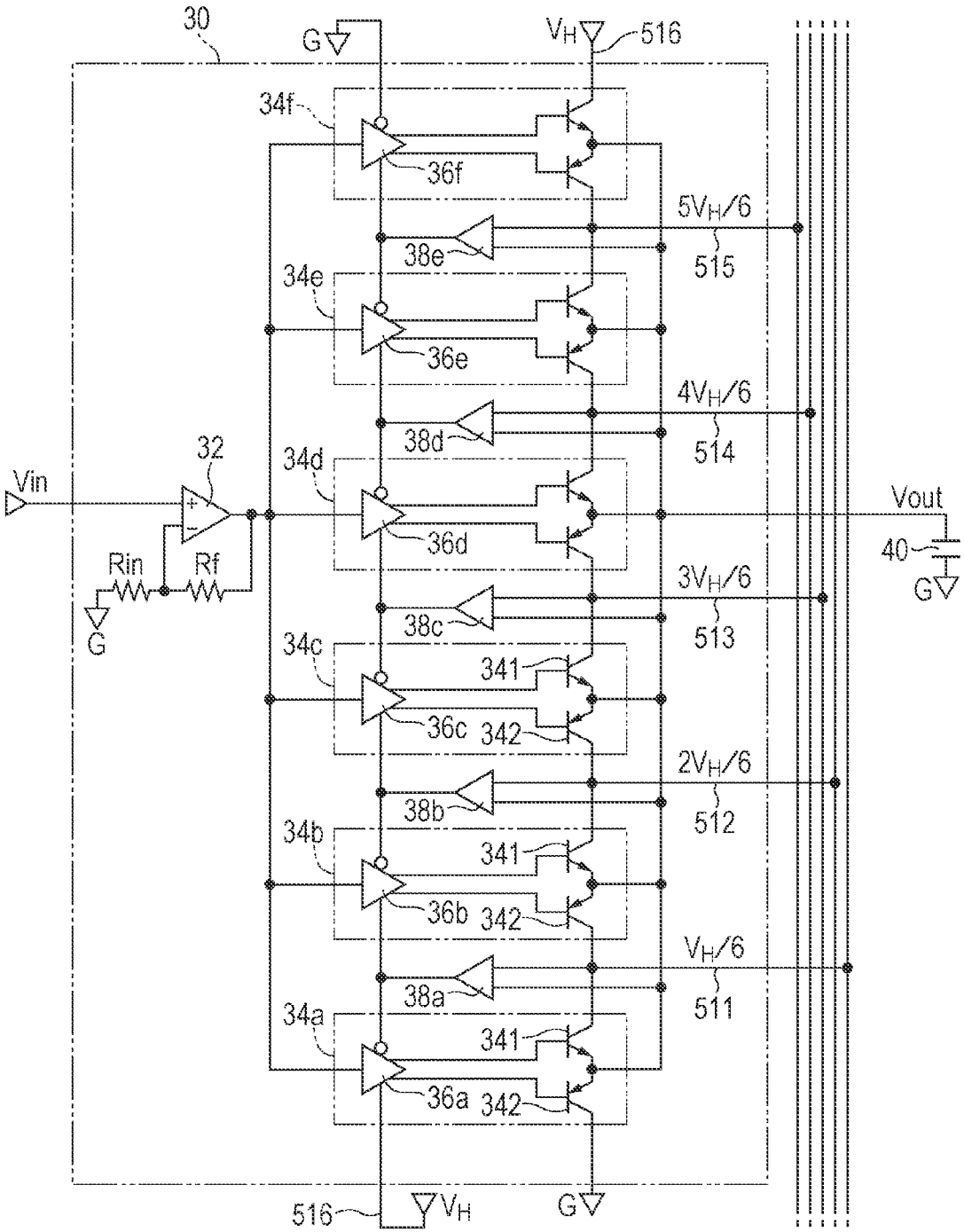
FIG. 4 is a diagram showing an example of the configuration of a driver in the print head.

FIG. 4 is a diagram showing an example of the configuration of the driver 30 that drives one of the piezoelectric elements 40. As shown in FIG. 4, the driver 30 generates the voltage Vout using seven voltages including voltage zero; specifically, generates the voltage Vout using the following voltages in low-to-high order of voltage zero (ground voltage G), 1/6 $V_H$, 2/6 $V_H$, 3/6 $V_H$, 4/6 $V_H$, 5/6 $V_H$, and $V_H$. The voltage 1/6 $V_H$ is supplied to the driver 30 from the auxiliary power supply unit 50 via the power supply wiring 511. Similarly, the voltages 2/6 $V_H$, 3/6 $V_H$, 4/6 $V_H$, and 5/6 $V_H$ are supplied to the respective drivers 30 from the auxiliary power supply unit 50 via power supply wirings 512, 513, 514, and 515. As shown in FIG. 4, the driver 30 includes an operational amplifier 32, unit circuits 34*a* to 34*f*, and comparators 38*a* to 38*e*. The driver 30 drives the piezoelectric element 40 according to the control signal Vin, from which the control signal COM is extracted by the selection unit 230.

The control signal Vin that is output from the selection unit 230 is supplied to the input terminal (+) of the operational amplifier 32, which is the input terminal of the driver 30. The output signal of the operational amplifier 32 is supplied to each of the unit circuits 34*a* to 34*f*, returns to the input terminal (−) of the operational amplifier 32 via the resistance Rf by negative feedback, and is further connected to the ground wiring 728 via the resistance Rin. Therefore, the operational amplifier 32 multiplies the control signal Vin by (1+Rf/Rin) using non-inverting amplification. It is possible to set the voltage amplification ratio of the operational amplifier 32 using the resistances Rf and Rin. However, for convenience, hereinafter Rf is set to zero and Rin is set to infinite. In other words, description is given with the assumption that the voltage amplification ratio of the operational amplifier 32 is "1", and that the control signal Vin is supplied as-is to the unit circuits 34*a* to 34*f*. Note that the voltage amplification ratio may also be a value other than "1".

Each of the unit circuits 34*a* to 34*f* is provided to correspond to two neighboring voltages, of the seven voltages described above, in low-to-high voltage order. Specifically, the unit circuit 34*a* corresponds to the voltage zero and the voltage 1/6 $V_H$, the unit circuit 34*b* corresponds to the voltage 1/6 $V_H$ and the voltage 2/6 $V_H$, the unit circuit 34*c* corresponds to the voltage 2/6 $V_H$ and the voltage 3/6 $V_H$, the unit circuit 34*d* corresponds to the voltage 3/6 $V_H$ and the voltage 4/6 $V_H$, the unit circuit 34*e* corresponds to the voltage 4/6 $V_H$ and the voltage 5/6 $V_H$, the unit circuit 34*f* corresponds to the voltage 5/6 $V_H$ and the voltage $V_H$.

The circuit configuration of each of the unit circuits 34*a* to 34*f* is the same as that of the others, and includes a level shifter that corresponds to one of the level shifters 36*a* to 36*f*, a bipolar NPN-type transistor 341 and a PNP-type transistor 342. Furthermore, when the unit circuits 34*a* to 34*f* are described generally without being specified, they will be described simply using the reference numeral "34". Similarly, when the level shifters 36*a* to 36*f* are described generally without being specified, they will be described simply using the reference numeral "36".

The level shifter 36 enters either an enable state or a disable state. Specifically, the level shifter 36 enters the enable state when the signal supplied to the negative control terminal, which is marked with a circular symbol, is an L level and the signal supplied to the positive control terminal, which is not marked with the circular symbol, is an H level. The level shifter 36 is in the disable state during other times.

As described below, of the seven voltages described above, the comparators 38*a* to 38*e* are associated one-for-one with the five voltages excluding the voltage zero and the voltage $V_H$. Here, focusing on the unit circuit 34, the output signal of the comparator that is associated with, of the two voltages associated with the unit circuit 34, the voltage of the high potential side is supplied to the negative control terminal of the level shifter 36 in the unit circuit 34. Furthermore, the output signal of the comparator that is associated with, of the two voltages associated with the unit circuit 34, the voltage of the low potential side is supplied to the positive control terminal of the level shifter 36. However, the negative control terminal of the level shifter 36*f* in the unit circuit 34*f* is connected to the ground wiring 728 of the voltage zero (the ground voltage G), which is equivalent to the L level. Conversely, the positive control terminal of the level shifter 36*a* in the unit circuit 34*a* is connected to a power supply wiring 516 (the wiring 726) that supplies the voltage $V_H$, which is equivalent to the H level.

In the enable state, the level shifter 36 causes the voltage of the input control signal Vin to shift in the negative direction by a predetermined value, and supplies the shifted voltage to the base terminal of the transistor 341, and causes the voltage of the control signal Vin to shift in the positive direction by a predetermined amount, and supplies the shifted voltage to the base terminal of the transistor 342. In the disable state, the level shifter 36 supplies a voltage that causes the transistor 341 to turn off, for example, the voltage VH to the base terminal of the transistor 341 regardless of the control signal Vin, and supplies a voltage that causes the transistor 342 to turn off, for example, the voltage zero to the base terminal of the transistor 342. Note that the predetermined value is set to the voltage (the bias voltage, approximately 0.6 volts) between the base and the emitter, when a current starts flowing to the emitter terminal. Therefore, the predetermined value is characterized according to the properties of the transistors 341 and 342, and is zero if the transistors 341 and 342 are ideal.

The collector terminal of the transistor 341 is connected to the power supply wiring that supplies the high potential side voltage of the two corresponding voltages. The collector terminal of the transistor 342 is connected to the power supply wiring that supplies the low potential side voltage. For example, in the unit circuit 34*a* that corresponds to the voltage zero and the voltage 1/6 $V_H$, the collector terminal of the transistor 341 is connected to the power supply wiring 511 that supplies the voltage 1/6 $V_H$, and the collector terminal of the transistor 342 is connected to the ground wiring 728 of the voltage zero (the ground voltage G). For example, in the unit circuit 34*b* that corresponds to the voltage 1/6 $V_H$ and the voltage 2/6 $V_H$, the collector terminal of the transistor 341 is connected to the power supply wiring 512 that supplies the voltage 2/6 $V_H$, and the collector terminal of the transistor 342 is connected to the power supply wiring 511 that supplies the voltage 1/6 $V_H$. Furthermore, in the unit circuit 34*f* that corresponds to the voltage 5/6 $V_H$ and the voltage $V_H$, the collector terminal of the transistor 341 is connected to the power supply wiring 516 that supplies the voltage $V_H$, and the collector terminal of the transistor 342 is connected to the power supply wiring 515 that supplies the voltage 5/6 $V_H$.

Meanwhile, the emitter terminals of the transistors 341 and 342 in the unit circuits 34*a* to 34*f* are connected in common to the first terminal of the piezoelectric element 40. In other words, the common connection point of the emitter terminals of the transistors 341 and 342 is connected to the first terminal of the piezoelectric element 40 as the output terminal of the driver 30. Therefore, the voltage of the first terminal of the piezoelectric element 40, that is, the voltage held by the piezoelectric element 40 is represented as the voltage Vout to include the meaning of the output voltage of the driver 30.

Of the seven voltages described above, the comparators 38*a* to 38*e* correspond to the five voltages excluding the voltage zero and the voltage $V_H$ of 1/6 $V_H$, 2/6 $V_H$, 3/6 $V_H$, 4/6 $V_H$, and 5/6 $V_H$, the levels of voltages supplied to the two input terminals are compared with one another and a signal indicating the comparison results is output. Here, of the two input terminals in the comparators 38*a* to 38*e*, the first terminal is connected to the power supply wiring that supplies the voltage that corresponds to itself, and the second terminal is connected to each emitter terminal of the transistors 341 and 342 and is connected in common to the first terminal of the piezoelectric element 40. For example, in regard to the comparator 38*a* that corresponds to the voltage 1/6 $V_H$, of the two input terminals thereof, the first terminal is connected to the power supply wiring 511, which supplies the voltage 1/6 $V_H$ corresponding to itself. In addition, for example, in regard to the comparator 38*b* that corresponds to the voltage 2/6 $V_H$, of the two input terminals, the first terminal is connected to the power supply wiring 512, which supplies the voltage 2/6 $V_H$ corresponding to itself.

In relation to the input terminal thereof, each of the comparators 38*a* to 38*e* outputs a signal of the H level if the voltage Vout of the second terminal is equal to or higher than the voltage of the first terminal, or of the L level if the voltage Vout is lower than the voltage of the first terminal. Specifically, for example, the comparator 38*a* that corresponds to the voltage 1/6 $V_H$ sets the output signal to the H level if the voltage Vout is equal to or higher than the voltage 1/6 $V_H$, and to the L level if the voltage Vout is lower than the voltage 1/6 $V_H$. For example, the comparator 38*b* that corresponds to the voltage 2/6 $V_H$ sets the output signal to the H level if the voltage Vout is equal to or higher than the voltage 2/6 $V_H$, and to the L level if the voltage Vout is lower than the voltage 2/6 $V_H$.

Focusing on one of the five voltages, the output signal of the comparator that corresponds to the voltage being focused on is supplied to the negative input terminal of the level shifter 36 of the unit circuit, in which the voltage is set to the high potential side voltage, and the positive input terminal of the level shifter 36 of the unit circuit, in which the voltage is set to the low potential side voltage. For example, the output signal of the comparator 38*a* that corresponds to the voltage 1/6 $V_H$ is supplied to the negative input terminal of the level shifter 36*a* of the unit circuit 34*a*, in which the voltage 1/6 $V_H$ is associated with the high potential side voltage, and the positive input terminal of the level shifter 36*b* of the unit circuit 34*b*, in which the voltage 1/6 $V_H$ is associated with the low potential side voltage. In addition, for example, the output signal of the comparator 38*b* that corresponds to the voltage 2/6 $V_H$ is supplied to the negative input terminal of the level shifter 36*b* of the unit circuit 34*b*, in which the voltage 2/6 $V_H$ is associated with the high potential side voltage, and the positive input terminal of the level shifter 36*c* of the unit circuit 34*c*, in which the voltage 2/6 $V_H$ is associated with the low potential side voltage.

Next, description will be given of the operations of the driver 30. First, description will be given of the states that the comparators 38*a* to 38*e* and the level shifter 36 enter in relation to the voltage Vout held by the piezoelectric element 40.

All of the output signals of the comparators 38*a* to 38*e* are the L level in a state (a first state) in which the voltage Vout is equal to or higher than the voltage zero and lower than the voltage 1/6 $V_H$. Therefore, in the first state, only the level shifter 36*a* enters the enable state, and the other level shifters 36*b* to 36*f* enter the disable state.

The output signal of the comparator 38*a* is the H level and the output signals of the other comparators 38*b* to 38*e* are the L level in a state (a second state) in which the voltage Vout is equal to or higher than the voltage 1/6 $V_H$ and lower than the voltage 2/6 $V_H$. Therefore, in the second state, only the level shifter 36*b* enters the enable state, and the other level shifters 36*a* and 36*c* to 36*f* enter the disable state.

The output signals of the comparators 38*a* and 38*b* are the H level and the output signals of the other comparators 38*c* to 38*e* are the L level in a state (a third state) in which the voltage Vout is equal to or higher than the voltage 2/6 $V_H$ and lower than the voltage 3/6 $V_H$. Therefore, in the third state, only the level shifter 36*c* enters the enable state, and the other level shifters 36*a*, 36*b* and 36*d* to 36*f* enter the disable state.

The output signals of the comparators 38*a* to 38*c* are the H level and the output signals of the other comparators 38*d* and 38*e* are the L level in a state (a fourth state) in which the voltage Vout is equal to or higher than the voltage 3/6 $V_H$ and lower than the voltage 4/6 $V_H$. Therefore, in the fourth state, only the level shifter 36*d* enters the enable state, and the other level shifters 36*a* to 36*c*, 36*e* and 36*f* enter the disable state.

The output signals of the comparators 38*a* to 38*d* are the H level and the output signals of the other comparator 38*e* is the L level in a state (a fifth state) in which the voltage Vout is equal to or higher than the voltage 4/6 $V_H$ and lower than the voltage 5/6 $V_H$. Therefore, in the fifth state, only the level shifter 36*e* enters the enable state, and the other level shifters 36*a* to 36*d* and 36*f* enter the disable state.

All of the output signals of the comparators 38*a* to 38*e* are the H level in a state (a sixth state) in which the voltage Vout is equal to or higher than the voltage 5/6 $V_H$ and lower than the voltage $V_H$. Therefore, in the sixth state, only the level shifter 36*f* enters the enable state, and the other level shifters 36*a* to 36*e* enter the disable state.

In this manner, in the first state, only the level shifter 36*a* enters the enable state, and similarly hereinafter, in the second state, the third state, the fourth state, the fifth state, and the sixth state, only the level shifter 36*b*, the level shifter 36*c*, the level shifter 36*d*, the level shifter 36*e*, and the level shifter 36*f* enter the enable state, respectively.

Note that, while the states from the first state to the sixth state are defined using the voltage Vout, the states can also be referred to as the state of the charge held (accumulated) in the piezoelectric element 40.

In the first state, when the level shifter 36*a* is in the enable state, the level shifter 36*a* supplies a voltage signal, which is obtained by level shifting the control signal Vin in the negative direction by a predetermined value, to the base terminal of the transistor 341 in the unit circuit 34*a*, and supplies a voltage signal, which is obtained by level shifting the control signal Vin in the positive direction by a predetermined value, to the base terminal of the transistor 342 in the unit circuit 34*a*.

Here, when the voltage of the control signal Vin is higher than the voltage Vout (the connection point voltage between the emitter terminals), a current that corresponds to the difference therebetween (the voltage between the base and the emitter, strictly speaking, the voltage obtained by subtracting the predetermined value from the voltage between the base and the emitter) flows from the collector terminal of the transistor 341 to the emitter terminal. Therefore, the voltage Vout slowly rises and approaches the voltage of the control signal Vin. When the voltage Vout eventually matches the voltage of the control signal Vin, the current flowing in the transistor 341 becomes zero at this point in time.

On the other hand, when the voltage of the control signal Vin is lower than the voltage Vout, a current that corresponds to the difference therebetween flows from the emitter terminal of the transistor 342 to the collector terminal. Therefore, the voltage Vout slowly falls and approaches the voltage of the control signal Vin. When the voltage Vout eventually matches the voltage of the control signal Vin, the current flowing in the transistor 342 becomes zero at this point in time.

Accordingly, in the first state, the transistors 341 and 342 of the unit circuit 34*a* execute control such that the voltage Vout is caused to match the control signal Vin.

Also in the first state, in the unit circuits 34*b* to 34*f* other than the unit circuit 34*a*, since the level shifter 36 enters the disable state, the voltage $V_H$ is supplied to the base terminal of the transistor 341 and the voltage zero is supplied to the base terminal of the transistor 342. Therefore, in the first state, in the unit circuits 34*b* to 34*f*, since the transistors 341 and 342 turn off, the transistors 341 and 342 do not influence the control of the voltage Vout.

Note that, here, description is given of the first state; however, the same operations are also performed in the second state to the sixth state. Specifically, according to the voltage Vout held by the piezoelectric element 40, the transistors 341 and 342 of the unit circuit, which becomes active together with one of the unit circuits 34*a* to 34*f* becoming active, perform control to cause the voltage Vout to match the control signal Vin. Therefore, when viewed as a whole, the driver 30 operates such that the voltage Vout follows the control signal Vin.

Figure 5A:
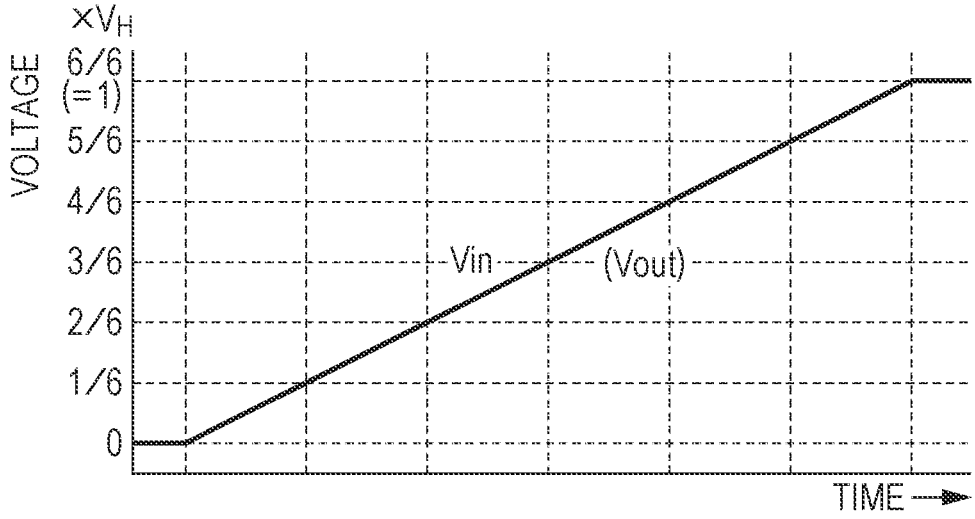
FIGS. 5A and 5B are diagrams illustrating the operations of the driver.
Figure 5B:
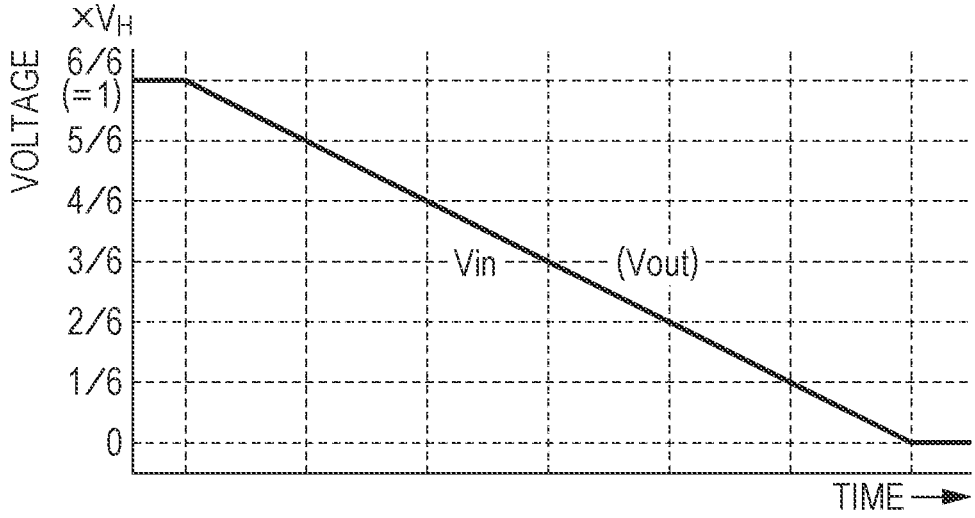

Accordingly, as shown in FIG. 5A, when the control signal Vin rises from the voltage zero to the voltage $V_H$, for example, the voltage Vout also changes from the voltage zero to the voltage $V_H$, following the control signal Vin. As shown in FIG. 5B, when the control signal Vin drops from the voltage $V_H$ to the voltage zero, the voltage Vout also changes from the voltage $V_H$ to the voltage zero, following the control signal Vin.

Figure 6A:
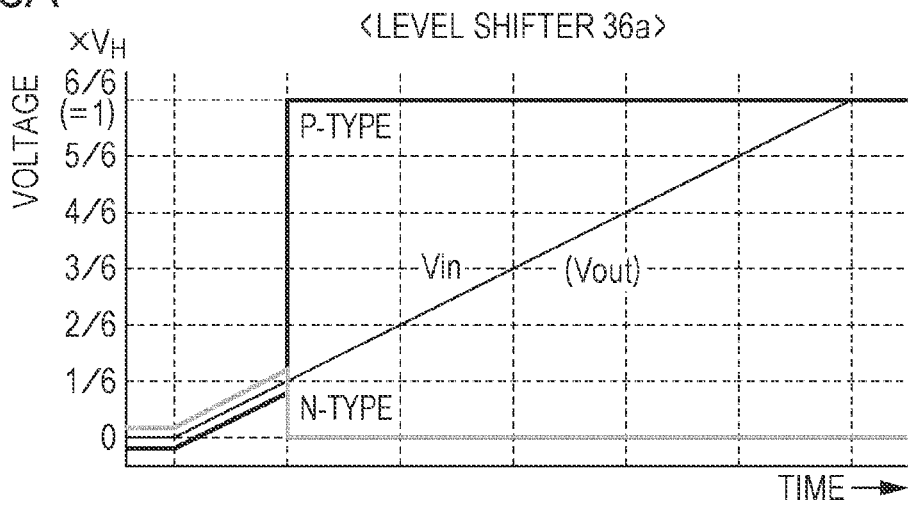
FIGS. 6A to 6C are diagrams illustrating the operations of a level shifter in the driver.
Figure 6B:
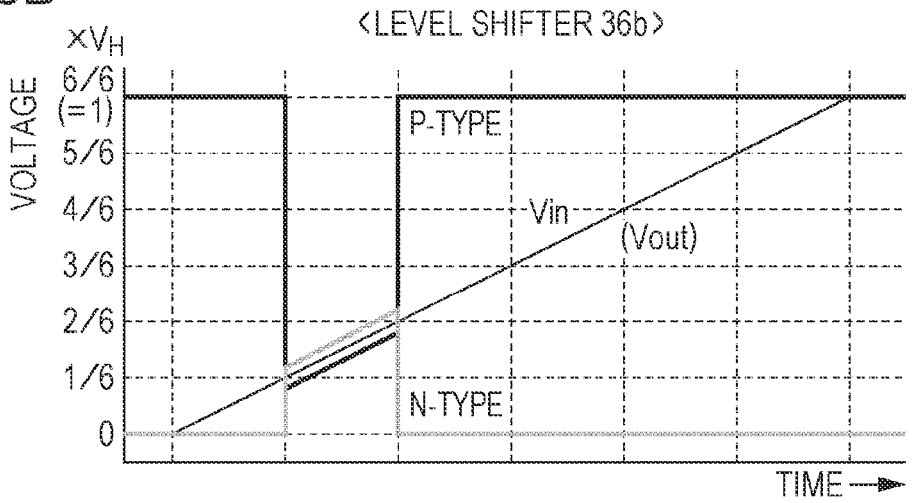
Figure 6C:
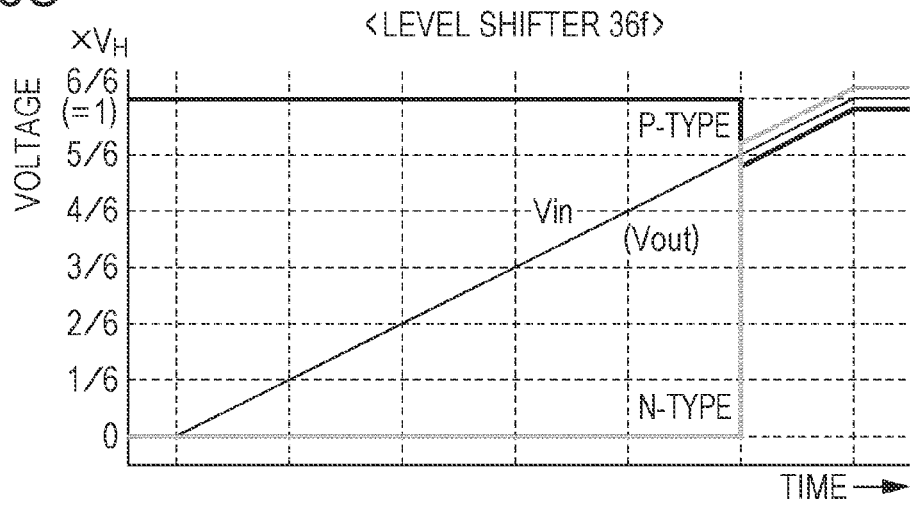

FIGS. 6A to 6C are diagrams illustrating the operations of the level shifter.

When the control signal Vin rises from the voltage zero to the voltage $V_H$, the voltage Vout also rises, following the control signal Vin. In the process of rising, when in the first state, in which the voltage Vout is equal to or higher than the voltage zero and lower than the voltage 1/6 $V_H$, the level shifter 36*a* is in the enable state. Therefore, as shown in FIG. 6A, the voltage (represented as "P-type") that is supplied to the base terminal of the transistor 341 by the level shifter 36*a* becomes a voltage obtained by shifting the control signal Vin in the negative direction by a predetermined amount, and the voltage (represented as "N-type") that is supplied to the base terminal of the transistor 342 becomes a voltage obtained by shifting the control signal Vin in the positive direction by a predetermined amount. On the other hand, when in a state other than the first state, since the level shifter 36*a* enters the disable state, the voltage that is supplied to the base terminal of the transistor 341 becomes $V_H$, and the voltage that is supplied to the base terminal of the transistor 342 becomes zero.

Note that, FIG. 6B shows a voltage waveform that is output by the level shifter 36*b*, and FIG. 6C shows a voltage waveform that is output by the level shifter 36*f*. Considering that, when in the second state, in which the voltage Vout is equal to or higher than the voltage zero and lower than the voltage 2/6 $V_H$, the level shifter 36*b* enters the enable state, and when in the sixth state, in which the voltage Vout is equal to or higher than the voltage 5/6 $V_H$ and less than the voltage $V_H$, the level shifter 36*f* enters the enable state, it is evident that description thereof is not particularly necessary.

Description of the operations of the level shifters 36*c* to 36*e* in the rising process of the voltage of the control signal Vin (or the voltage Vout), and description of the operations of the level shifters 36*a* to 36*f* in the falling process of the voltage of the control signal Vin (or the voltage Vout) will also be omitted.

Next, description will be given of the flow of current (charge) in the unit circuits 34*a* to 34*f*, using the unit circuits 34*a* and 34*b* as examples. Note that the description will be divided into when charging and when discharging take place.

Figure 7:
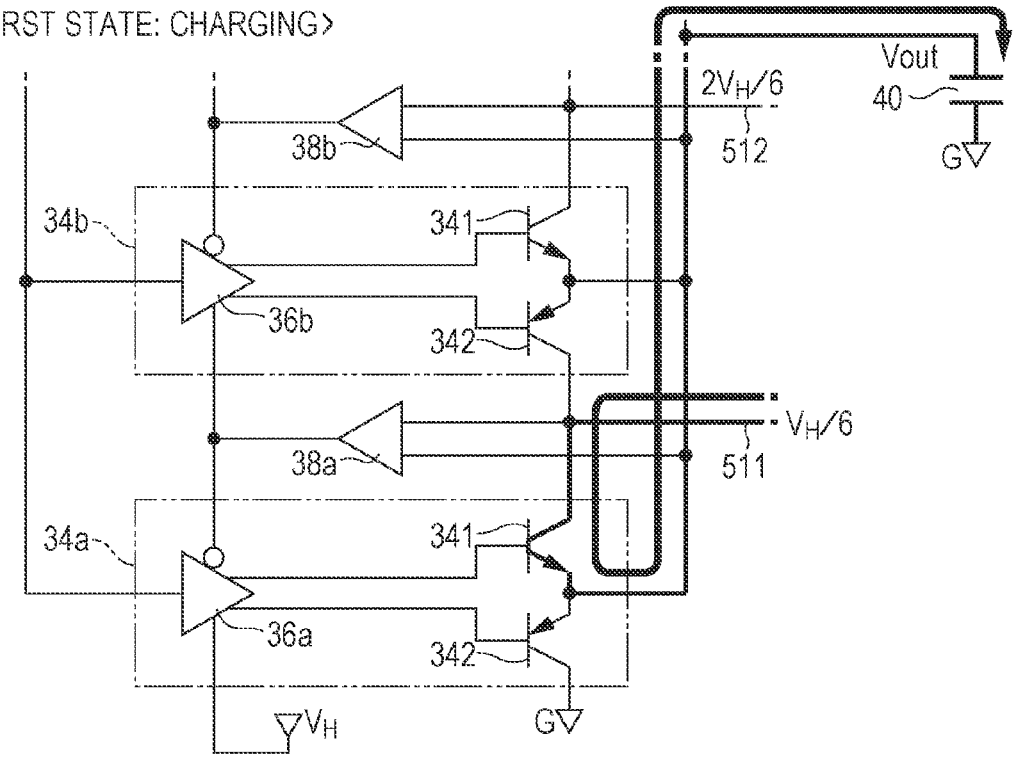
FIG. 7 is a diagram for illustrating the flow of a current (a load) in the driver.

FIG. 7 is a diagram illustrating the operation when the piezoelectric element 40 is charged, when in the first state (the state in which the voltage Vout is equal to or higher than the voltage zero and lower than the voltage 1/6 $V_H$).

In the first state, the level shifter 36*a* enters the enable state, and the other level shifters 36*b* to 36*f* enter the disable state; therefore, only the unit circuit 34*a* may be focused on.

In the first state, when the voltage of the control signal Vin is higher than the voltage Vout, a current that corresponds to the voltage between the base and the emitter of the transistor 341 of the unit circuit 34*a* flows. Accordingly, the transistor 341 of the unit circuit 34*a* functions as the first transistor. Note that the transistor 342 of the unit circuit 34*a* is off at this time.

At this time, the current flows along a path of the power supply wiring 511→the transistor 341 (of the unit circuit 34*a*)→the piezoelectric element 40, as shown by the arrows in FIG. 7, and the piezoelectric element 40 is charged with a charge. The voltage Vout rises according to the charging.

When the voltage Vout matches the voltage of the control signal Vin, the transistor 341 of the unit circuit 34*a* turns off; thus, the charging to the piezoelectric element 40 stops.

On the other hand, when the control signal Vin rises to be equal to or higher than the voltage 1/6 $V_H$, since the voltage Vout follows the control signal Vin, the voltage Vout becomes equal to or higher than the voltage 1/6 $V_H$, and transitions from the first state to the second state (the state in which the voltage Vout is equal to or higher than the voltage 1/6 $V_H$ and lower than the voltage 2/6 $V_H$).

Figure 8:
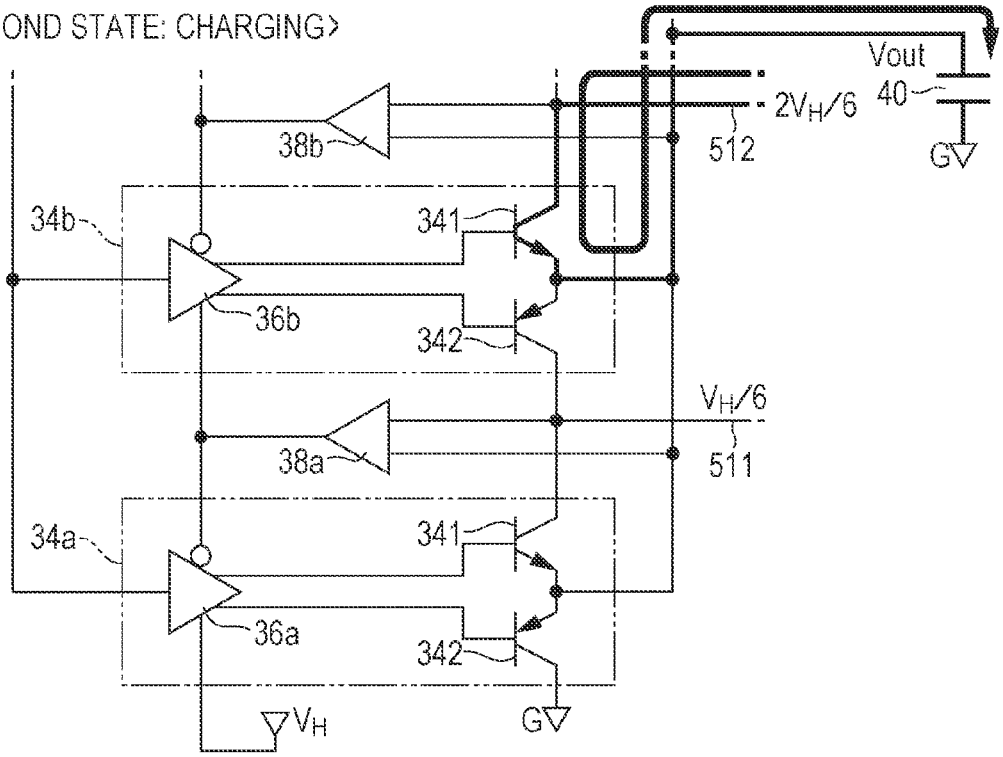
FIG. 8 is a diagram for illustrating the flow of a current (a load) in the driver.

FIG. 8 is a diagram illustrating the operation in the second state, when the piezoelectric element 40 is charged.

In the second state, the level shifter 36*b* enters the enable state, and the other level shifters 36*a* and 36*c* to 36*f* enter the disable state; therefore, only the unit circuit 34*b* may be focused on.

In the second state, when the control signal Vin is higher than the voltage Vout, a current that corresponds to the voltage between the base and the emitter of the transistor 341 of the unit circuit 34*b* flows. Accordingly, the transistor 341 of the unit circuit 34*b* functions as the third transistor. Note that the transistor 342 of the unit circuit 34*b* is off at this time.

At this time, the current flows along a path of the power supply wiring 512→the transistor 341 (of the unit circuit 34*b*)→the piezoelectric element 40, as shown by the arrows in FIG. 8, and the piezoelectric element 40 is charged with a charge. In other words, in the second state, when the piezoelectric element 40 is charged, the first terminal of the piezoelectric element 40 is electrically connected to the auxiliary power supply unit 50 via the power supply wiring 512.

In this manner, when transitioning from the first state to the second state during the rising of the voltage Vout, the supply source of the current switches from the power supply wiring 511 to the power supply wiring 512.

When the voltage Vout matches the voltage of the control signal Vin, the transistor 341 of the unit circuit 34*b* turns off; thus, the charging to the piezoelectric element 40 stops.

On the other hand, when the control signal Vin rises to be equal to or higher than the voltage 2/6 $V_H$, since the voltage Vout follows the control signal Vin, the voltage Vout becomes equal to or higher than the voltage 2/6 $V_H$, and, as a result, transitions from the second state to the third state (the state in which the voltage Vout is equal to or higher than the voltage 2/6 $V_H$ and lower than the voltage 3/6 $V_H$).

Note that, while the charging operations from the third state to the sixth state are not particularly shown in the drawings, the supply source of the current switches in stages between the power supply wirings 513, 514, 515, and 516.

Figure 9:
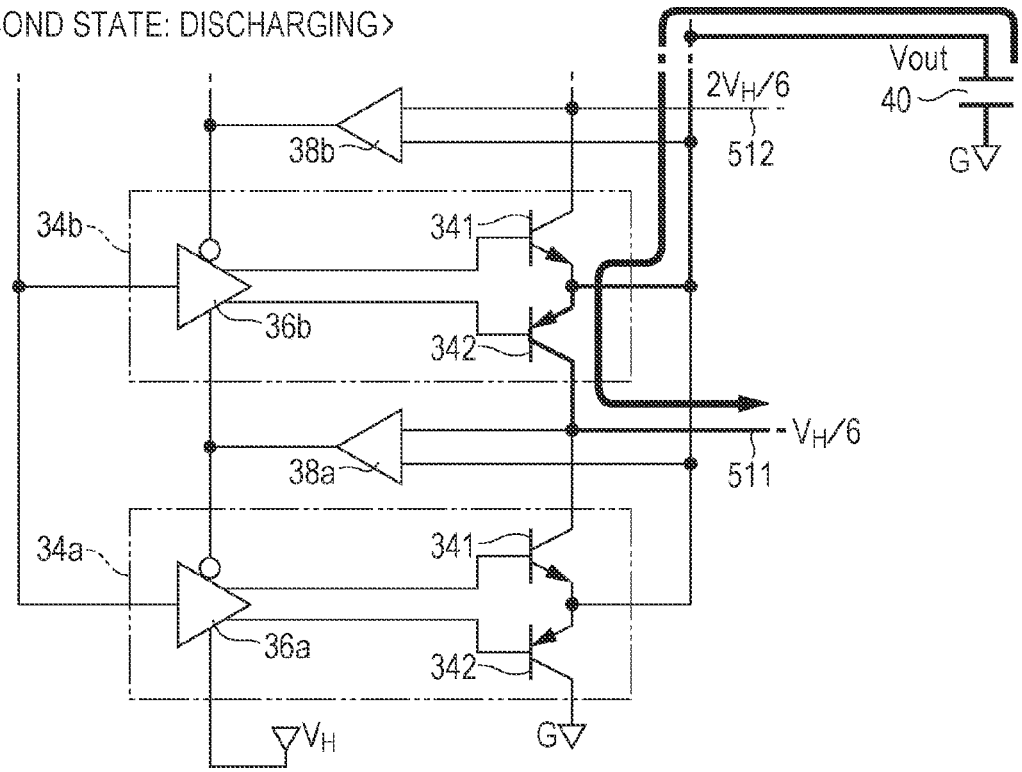
FIG. 9 is a diagram for illustrating the flow of a current (a load) in the driver.

FIG. 9 is a diagram illustrating the operation when the piezoelectric element 40 is discharged in the second state.

In the second state, the level shifter 36*b* enters the enable state. In this state, when the control signal Vin is lower than the voltage Vout, a current that corresponds to the voltage between the base and the emitter of the transistor 342 of the unit circuit 34*b* flows. Accordingly, the transistor 341 of the unit circuit 34*b* functions as the second transistor. Note that the transistor 341 of the unit circuit 34*b* is off at this time.

At this time, the current flows along a path of the piezoelectric element 40→the transistor 342 (of the unit circuit 34*b*)→the power supply wiring 511, as shown by the arrows in FIG. 9, and a charge is discharged from the piezoelectric element 40. In other words, when the piezoelectric element 40 is charged with a charge in the first state, and, when a charge is discharged from the piezoelectric element 40 in the second state, the first terminal of the piezoelectric element 40 is electrically connected to the auxiliary power supply unit 50 via the power supply wiring 511. In addition, the power supply wiring 511 supplies a current (a charge) during the charging of the first state, and recovers the current (the charge) during the discharging of the second state. Note that the recovered charge is redistributed by the auxiliary power supply unit 50, which is described later, and reused.

When the voltage Vout matches the voltage of the control signal Vin, the transistor 342 of the unit circuit 34*b* turns off; thus, the discharging from the piezoelectric element 40 stops.

On the other hand, when the control signal Vin falls to lower than the voltage 1/6 $V_H$, since the voltage Vout follows the control signal Vin, the voltage Vout becomes lower than the voltage 1/6 $V_H$, and transitions from the second state to the first state.

Figure 10:
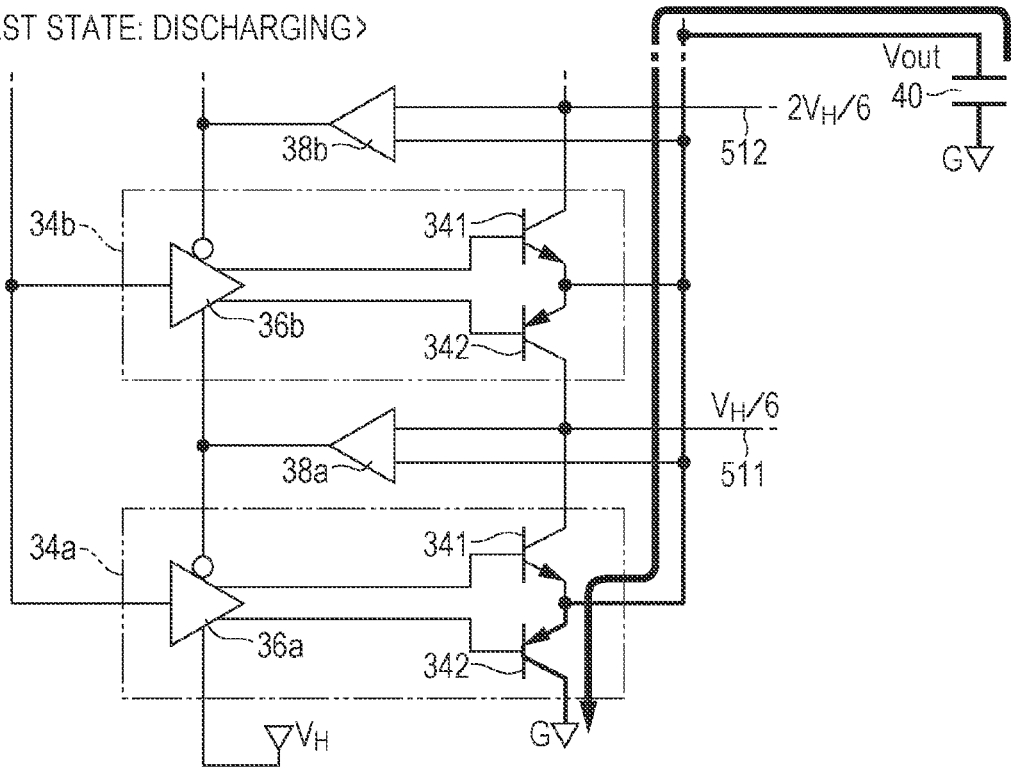
FIG. 10 is a diagram for illustrating the flow of a current (a load) in the driver.

FIG. 10 is a diagram illustrating the operation when the piezoelectric element 40 is discharged in the first state.

In the first state, the level shifter 36*a* enters the enable state. In this state, when the control signal Vin is lower than the voltage Vout, a current that corresponds to the voltage between the base and the emitter of the transistor 342 of the unit circuit 34*a* flows.

Note that the transistor 341 of the unit circuit 34*a* is off at this time.

At this time, the current flows along a path of the piezoelectric element 40→the transistor 342 (of the unit circuit 34*a*)→the ground wiring 728, as shown by the arrow in FIG. 10, and a charge is discharged from the piezoelectric element 40.

Note that, here, description is given divided into when charging and when discharging take place using the unit circuits 34*a* and 34*b* as examples; however, the unit circuits 34*c* to 34*f* operate in approximately the same manner, except that the transistors 341 and 342 that control the current are different.

In other words, the power supply wiring 512 supplies a current (a charge) during the charging of the second state and recovers the current (the charge) during the discharging of the third state, the power supply wiring 513 supplies a current (a charge) during the charging of the third state and recovers the current (the charge) during the discharging of the fourth state, the power supply wiring 514 supplies a current (a charge) during the charging of the fourth state and recovers the current (the charge) during the discharging of the fifth state, the power supply wiring 515 supplies a current (a charge) during the charging of the fifth state and recovers the current (the charge) during the discharging of the sixth state, the power supply wiring 516 supplies a current (a charge) during the charging of the sixth state, and the recovered charge is redistributed by the auxiliary power supply unit 50 and reused.

As can be understood from the above description, each of the drivers 30 of the element drive unit 240 functions as an element that executes an operation in which the auxiliary power supply unit 50 is caused to supply a charge that corresponds to the control signal COM to the piezoelectric element 40, and an operation in which the piezoelectric element 40 is caused to discharge a charge that corresponds to the control signal COM to the auxiliary power supply unit 50. Note that, in the discharging paths and the charging paths in each of the states, the path is common from the first terminal of the piezoelectric element 40 to the connection point of the emitter terminals in the transistors 341 and 342.

In general, when the capacity of a capacitive load such as the piezoelectric element 40 is represented as C, and the voltage amplitude as E, the energy P that is accumulated in the capacitive load is represented by $P=(C\cdot E^2)/2$.

The piezoelectric element 40 works by deforming according to the energy P; however, the amount of work spent causing the ink to be discharged accounts for 1% or less of the energy P. Accordingly, the piezoelectric element 40 can be perceived as a simple capacitance. When the capacity C is charged by a fixed power supply, an energy equivalent to $(C\cdot E^2)/2$ is consumed by the charging circuit. When discharging, an equal amount of energy is also consumed by the discharge circuit.

Merits of Driver 30

Figure 11A:
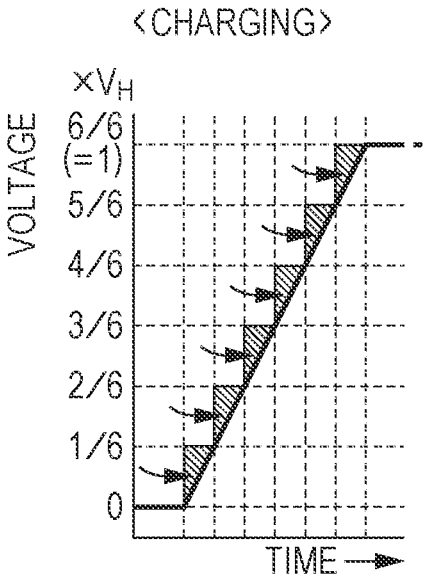
FIGS. 11A and 11B are diagrams illustrating a loss during charging and discharging of the driver.

In this embodiment, when the piezoelectric element 40 is charged from the voltage zero to the voltage $V_H$, the piezoelectric element 40 is charged through the six stages of from the voltage zero to the voltage 1/6 $V_H$, from the voltage 1/6 $V_H$ to the voltage 2/6 $V_H$, from the voltage 2/6 $V_H$ to the voltage 3/6 $V_H$, from the voltage 3/6 $V_H$ to the voltage 4/6 $V_H$, from the voltage 4/6 $V_H$ to the voltage 5/6 $V_H$, and from the voltage 5/6 $V_H$ to the voltage $V_H$. Therefore, in this embodiment, the loss during the charging is merely an amount that is equivalent to the area of the shaded region in FIG. 11A. Specifically, in this embodiment, the loss during the charging in the piezoelectric element 40 is merely 6/36 (=16.7%) in comparison with linear amplification, in which the charging is performed at once from the voltage zero to the voltage $V_H$.

Figure 11B:
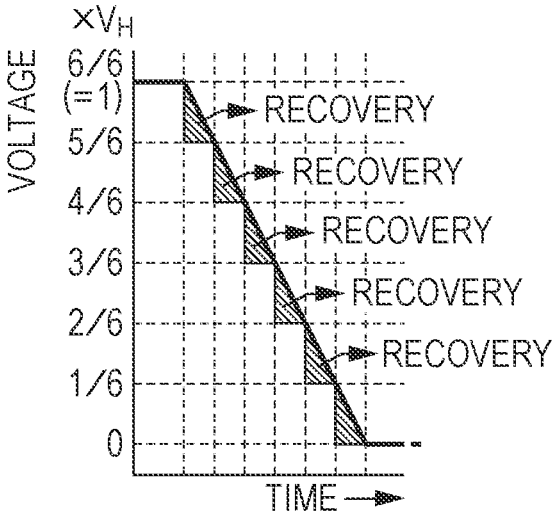

On the other hand, in this embodiment, since the discharging is also performed in stages, the loss during the discharging, as shown by a portion equivalent to the area of the shaded region in FIG. 11B, is also 6/36 (=16.7%) in comparison to a linear system, in which discharging is performed at once from the voltage $V_H$ to the voltage zero.

However, in this embodiment, since the total charge calculated as the loss during the discharging is recovered and redistributed by the auxiliary power supply unit 50 (described below) and reused, except for a case in which discharging is performed from the voltage 1/6 $V_H$ to the voltage zero, it is possible to obtain further power consumption reduction.

Auxiliary Power Supply Unit 50

Figure 12:
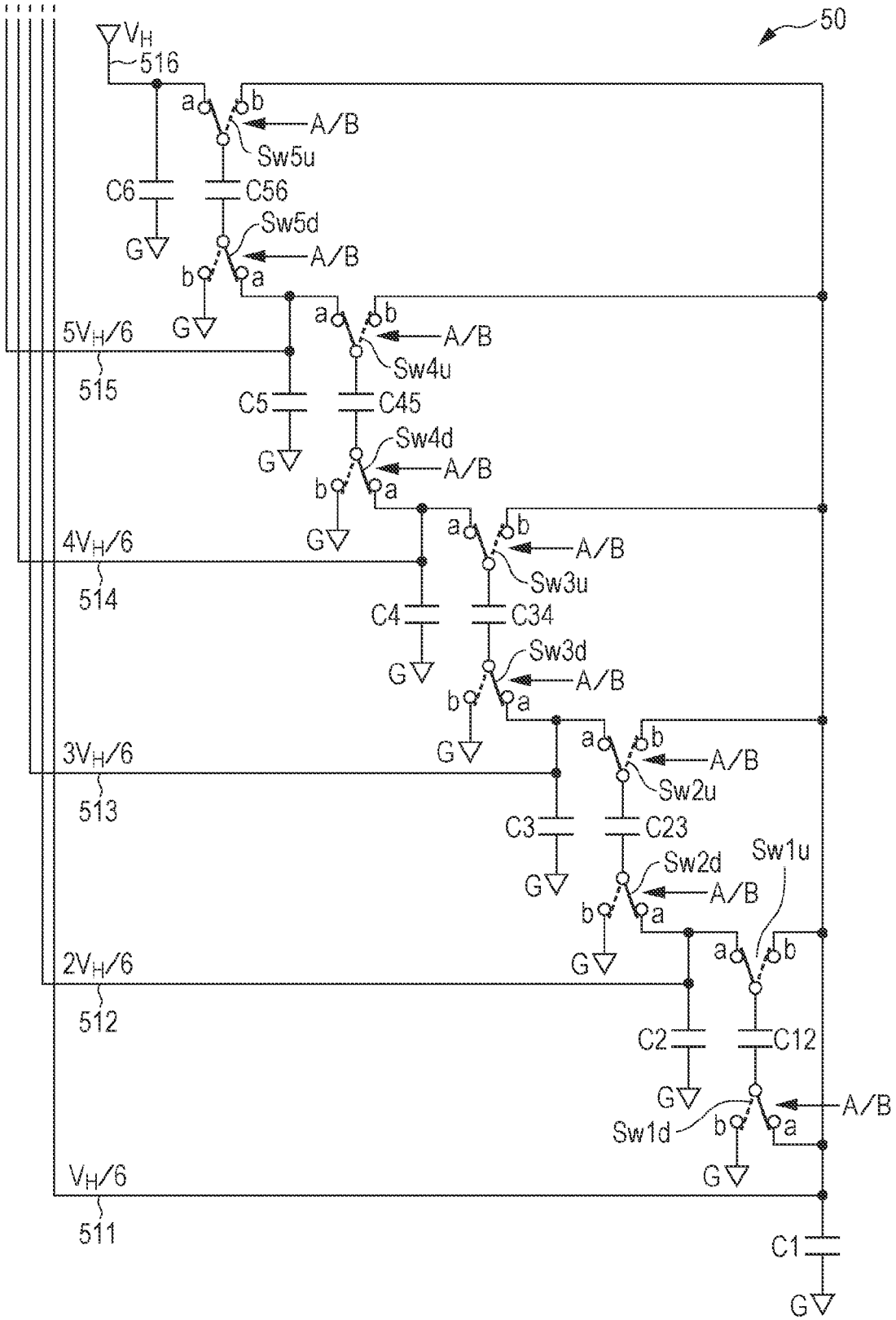
FIG. 12 is a diagram showing an example of the configuration of an auxiliary power supply unit.

FIG. 12 is a diagram showing an example of the configuration of the auxiliary power supply unit 50.

As shown in FIG. 12, the auxiliary power supply unit 50 is configured to include switches Sw1*d*, Sw1*u*, Sw2*d*, Sw2*u*, Sw3*d*, Sw3*u*, Sw4*d*, Sw4*u*, Sw5*d*, and Sw5*u*, and capacitive elements C12, C23, C34, C45, C56, C1, C2, C3, C4, C5, and C6.

Of these, the switches are all single pole double throw switches, and the common terminal connects to one of the terminals a or b according to the control signal A or B. The control signal A or B can be described in a simplified manner as, for example, a pulse signal with a duty ratio of approximately 50% in which the frequency thereof is set to, for example, approximately 20 times the frequency of the control signal COM. The control signal A or B may be generated by an internal oscillator (not shown) in the auxiliary power supply unit 50, and may also be supplied from the control unit 10 via the FFC 70.

Meanwhile, the capacitive elements C12, C23, C34, C45, and C56 are for moving charges, and the capacitive elements C1, C2, C3, C4, and C5 are used as backups. Note that the capacitive element C6 is for supplying the power supply voltage $V_H$.

The switches described above are actually configured by combining transistors in the semiconductor integrated circuit, and the capacitive elements are implemented externally in relation to the semiconductor integrated circuit. Furthermore, a configuration in which a plurality of the drivers 30 described above are formed on the semiconductor integrated circuit is desirable.

In the auxiliary power supply unit 50, the power supply wiring 516 that supplies the voltage $V_H$ is connected between the first terminal of the capacitive element C6 and a terminal a of the switch Sw5*u*. The common terminal of the switch Sw5*u* is connected to the first terminal of the capacitive element C56, and the second terminal of the capacitive element C56 is connected to the common terminal of the switch Sw5*d*. The terminal a of the switch Sw5*d* is connected between the first terminal of the capacitive element C5 and the terminal a of the switch Sw4*u*. The common terminal of the switch Sw4*u* is connected to the first terminal of the capacitive element C45, and the second terminal of the capacitive element C45 is connected to the common terminal of the switch Sw4*d*. The terminal a of the switch Sw4*d* is connected between the first terminal of the capacitive element C4 and the terminal a of the switch Sw3*u*. The common terminal of the switch Sw3*u* is connected to the first terminal of the capacitive element C34, and the second terminal of the capacitive element C34 is connected to the common terminal of the switch Sw3*d*. The terminal a of the switch Sw3*d* is connected between the first terminal of the capacitive element C3 and the terminal a of the switch Sw2*u*. The common terminal of the switch Sw2*u* is connected to the first terminal of the capacitive element C23, and the second terminal of the capacitive element C23 is connected to the common terminal of the switch Sw2*d*. The terminal a of the switch Sw2*d* is connected between the first terminal of the capacitive element C2 and the terminal a of the switch Sw1*u*. The common terminal of the switch Sw1*u* is connected to the first terminal of the capacitive element C12, and the second terminal of the capacitive element C12 is connected to the common terminal of the switch Sw1*d*. The terminal a of the switch Sw1*d* is connected to the first terminal of the capacitive element C1.

The first terminal of the capacitive element C5 is connected to the power supply wiring 515. Similarly, the first terminals of the capacitive elements C4, C3, C2, and C1 are respectively connected to the power supply wirings 514, 513, 512, and 511.

Furthermore, each of the terminals b of the switches Sw5*u*, Sw4*u*, Sw3*u*, Sw2*u*, and Sw1*u* are connected, together with the terminal a of the switch Sw1*d*, to the first terminal of the capacitive element C1. Each of the second terminals of the capacitive elements C6, C5, C4, C3, C2, and C1 and each of the terminals b of the switches Sw5*d*, Sw4*d*, Sw3*d*, Sw2*d*, and Sw1*d* are connected in common to the ground wiring 728.

Figure 13A:
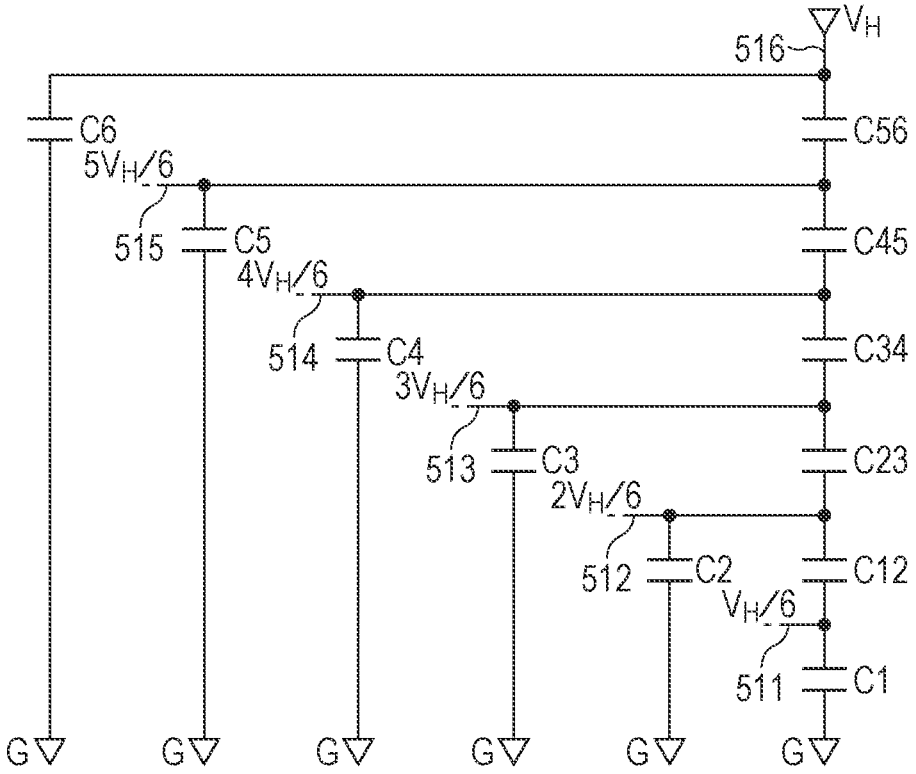
FIGS. 13A and 13B are diagrams illustrating the operations of the auxiliary power supply unit.
Figure 13B:
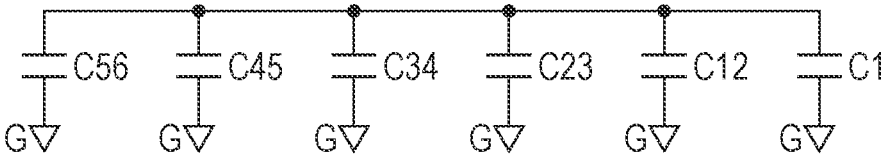

FIGS. 13A and 13B are diagrams showing the connection state of the switches in the auxiliary power supply unit 50.

According to the control signal A or B, each of the switches assumes one of two states of a state (state A) in which the common terminal is connected to the terminal a, and a state (state B) in which the common terminal is connected to the terminal b. FIG. 13A shows the connections of the state A in the auxiliary power supply unit 50 and FIG. 13B shows the connections of the state B. Both FIGS. 13A and 13B show simplified equivalent circuits.

In the state A, the capacitive elements C56, C45, C34, C23, C12, and C1 are connected in series between the wiring 726 (the voltage $V_H$) and the ground wiring 728 (the ground voltage G). In the state B, the first terminals of the capacitive elements C56, C45, C34, C23, C12, and C1 are connected to one another; thus, the capacitive elements thereof are connected in parallel, and the voltages held therein are equalized.

Accordingly, when the states A and B are repeated alternately, the voltages 1/6 $V_H$ that are equalized during the state B are multiplied from 1 to 5 times by the series connections of the state A, and the voltages held at this time are supplied to the driver 30 via the power supply wirings 511 to 515 in addition to being held in the capacitive elements C1 to C5.

Here, when the piezoelectric element 40 is charged by the driver 30, of the capacitive elements C1 to C5, some emerge in which the held voltage decreases. The capacitive elements in which the held voltage decreased are supplied with a charge from the power supply due to the series connection of the state A, and since the capacitive elements are equalized by the redistribution due to the parallel connection of the state B, a balance is maintained at the voltage 1/6 $V_H$, 2/6 $V_H$, 3/6 $V_H$, 4/6 $V_H$, and 5/6 $V_H$ from the perspective of the entire auxiliary power supply unit 50.

On the other hand, when the piezoelectric element 40 is discharged by the driver 30, of the capacitive elements C1 to C5, some emerge in which the held voltage rises; however, the charge is swept out due to the series connection of the state A, and since the capacitive elements are equalized by the redistribution due to the parallel connection of the state B, a balance is maintained at the voltage 1/6 $V_H$, 2/6 $V_H$, 3/6 $V_H$, 4/6 $V_H$, and 5/6 $V_H$ from the perspective of the entire auxiliary power supply unit 50. Note that, when the current that is swept out cannot be absorbed by the capacitive elements C56, C45, C34, C23, C12, and C1, and thus an excess charge remains, the excess charge is absorbed by the capacitive element C6, that is, returned to the power supply system. Therefore, if there is another load, other than the piezoelectric element 40, the charge is used to drive the load. If there is not another load, since the charge is absorbed by the other capacitive elements including the capacitive element C6, the power supply voltage $V_H$ rises, that is, rippling occurs; however, such rippling can be practically avoided by increasing the capacity of the coupling capacitors including the capacitive element C6. As can be understood from the above description, the auxiliary power supply unit 50 (the capacitive elements C1, C2, C3, C4, and C5) functions as an element (a charge supply source) that supplies a charge to each of the drivers (each of the piezoelectric elements 40).

When the voltages 1/6 $V_H$, 2/6 $V_H$, 3/6 $V_H$, 4/6 $V_H$, and 5/6 $V_H$, which are generated by the auxiliary power supply unit 50, are supplied to the drivers 30, in addition to being able to obtain a reduction in power consumption, the following merits are also obtained. In other words, even when the voltage $V_H$ that is supplied from the main power supply unit 180 is changed, the voltages 1/6 $V_H$, 2/6$V_H$, 3/6 $V_H$, 4/6 $V_H$, and 5/6 $V_H$ are changed to correspond to the changed voltage $V_H$.

Figure 14A:
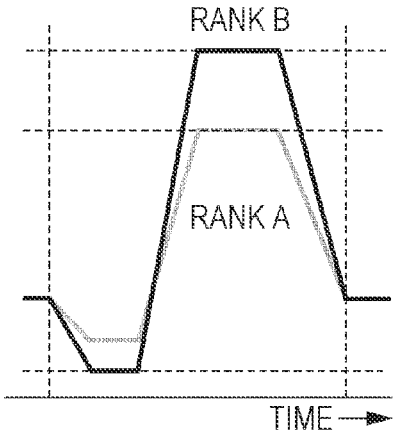
FIGS. 14A and 14B are diagrams showing the voltage change of the auxiliary power supply unit.

The amplitude of the power supply voltage $V_H$ has a characteristic in that the amplitude is to be set according to the individual performance of the piezoelectric elements 40. Therefore, the (high efficiency) piezoelectric element 40, which has high performance, may be driven using a relatively low amplitude such as that indicated as rank A in FIG. 14A. In contrast, the (low efficiency) piezoelectric element 40, which has low performance, has to be driven using a relatively high amplitude such as that indicated as rank B.

When the voltage $V_H$ is fixed in a high state to accommodate rank B in order to drive the piezoelectric elements 40 of both ranks A and B, the loss increases. In particular, there is a great amount of waste when driving the rank A piezoelectric elements, for which a low amplitude is sufficient.

Figure 14B:
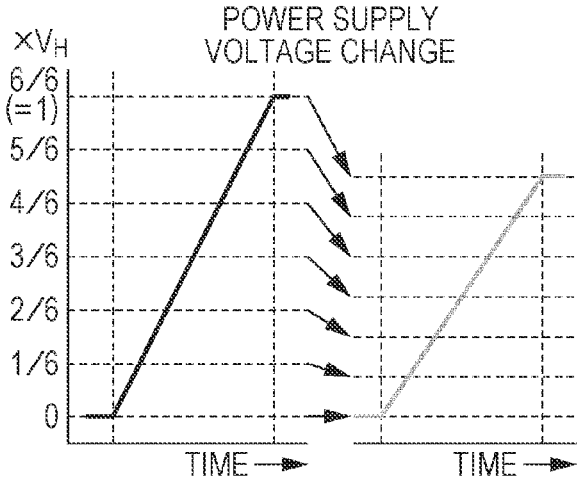

Therefore, as shown in FIG. 14B, when the voltage $V_H$ is set appropriately to accommodate the performance (the efficiency) of the piezoelectric elements 40, in particular, it is possible to suppress wasteful loss even when driving the rank A piezoelectric elements.

Note that, in the auxiliary power supply unit 50, when the common terminal of each of the switches is switched from connecting to one of the terminals a and b to connecting to the other, if there are variations in the properties of the plurality (10 in FIG. 12) of switches, it is possible that a state in which the switches do not all switch at once will occur, causing short circuiting between the two terminals of the capacitive elements. For example, during the switching, when the terminal a of each of the switches Sw1*u*, Sw1*d*, and Sw2*d* are connected to the common terminal, if a state occurs in which the terminal b of the switch Sw2*u* is connected to the common terminal, the two terminals of each of the capacitive elements C12 and C23 in the series connection are short circuited with one another.

Therefore, it is preferable to adopt a configuration in which the occurrence of short circuiting is suppressed by, during the switching of the switches, temporarily entering a neutral state in which neither the terminal a or b is connected. The above description is the configuration of the auxiliary power supply unit 50.

In this embodiment, the element drive unit 240 and the auxiliary power supply unit 50 of the configuration described above are implemented on the print head substrate 22; however, it is also conceivable to adopt the configuration shown in FIG. 15 (hereinafter referred to as the "comparative example") as the configuration that drives the plurality of piezoelectric elements 40. In the comparative example of FIG. 15, in addition to the print data generating unit 120 and the control signal supply unit 140, a voltage amplifier 192 and a current amplifier 194 are installed on the control substrate 12. The voltage amplifier 192 amplifies the voltage of the control signal COM, which is generated by the control signal supply unit 140, and the current amplifier 194 amplifies the current of the control signal COM after the amplification performed by the voltage amplifier 192. After being amplified by the current amplifier 194, the control signal COMa passes through the control wiring 724 of the FFC 70 and is supplied to the print head substrate 22.

In addition, in the comparative example, a plurality of high breakdown voltage switches 234 and a head control unit 220 are installed on the print head substrate 22. Each of the high breakdown voltage switches 234 corresponds one-for-one with each of the piezoelectric elements 40, and switches between the supply and cut-off of the control signal COM in relation to the corresponding piezoelectric element 40. The head control unit 220 controls each of the high breakdown voltage switches 234 according to the print data DP that is generated by the print data generating unit 120.

Figure 15:
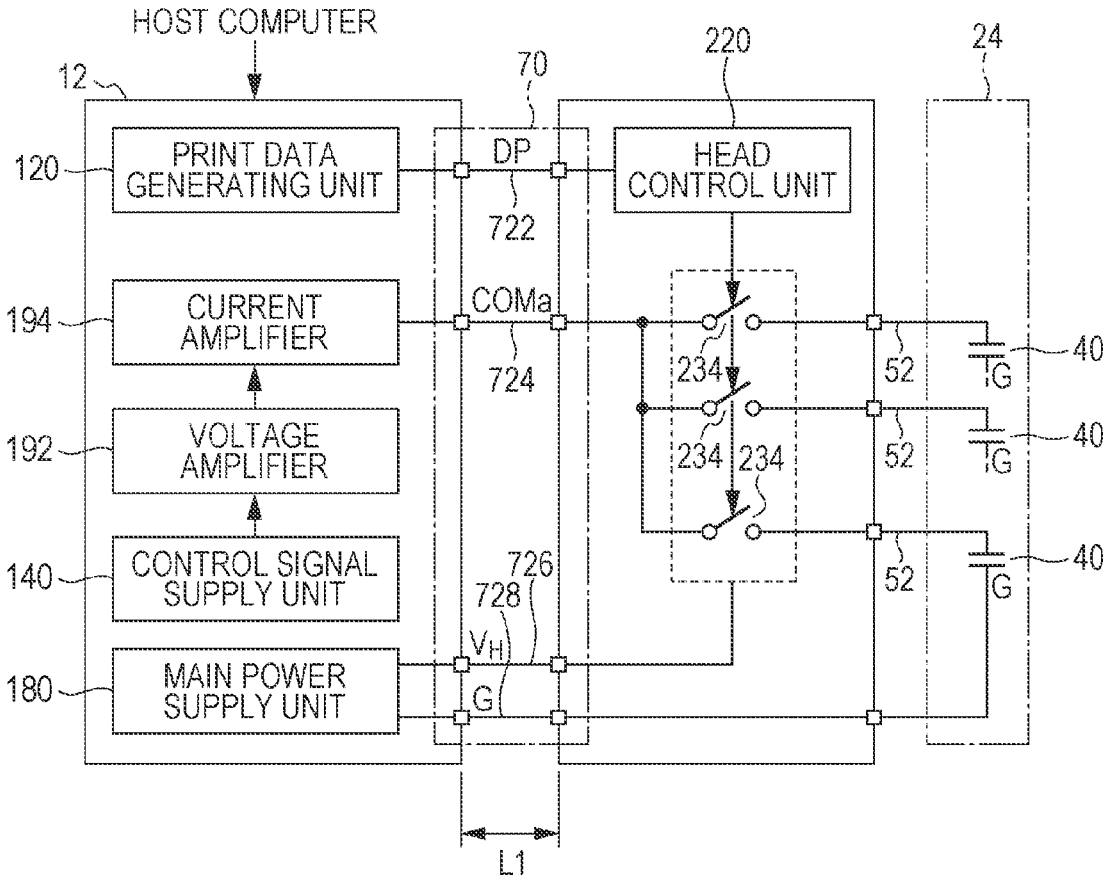
FIG. 15 is a block diagram of a comparative example.

In the comparative example of FIG. 15, since the control signal COMa is supplied to each of the piezoelectric elements 40 via the high breakdown voltage switch 234, focusing on the current path from the control wiring 724 to the ground wiring 728 that passes through each of the piezoelectric elements 40, the drive load fluctuates according to the total number of piezoelectric elements 40 to which the control signal COMa is supplied. In order to supply the control signal COMa of an appropriate waveform to each of the piezoelectric elements 40 even when the drive load is great (when the control signal COMa is supplied to a large number of the piezoelectric elements 40 in parallel), it is necessary to sufficiently amplify the current amount of the control signal COMa, which is supplied from the control substrate 12 to the print head substrate 22, using the current amplifier 194 on the control substrate 12. Accordingly, it becomes a problem to secure the control wiring 724 capable of transmitting an extremely large current in the FFC 70.

Figure 16:
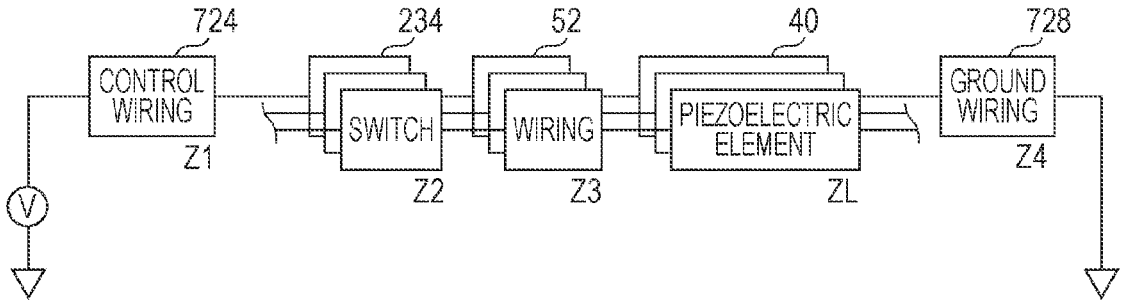
FIG. 16 is a schematic diagram for illustrating a problem of the comparative example.

The current path of the comparative example is modeled as shown in FIG. 16. The symbol Z1 of FIG. 16 refers to the impedance of, within the FFC 70, the control wiring 724 that transmits the control signal COMa, and the symbol F4 refers to the impedance of, within the FFC 70, the ground wiring 728 that transmits the ground voltage G. The symbol Z2 of FIG. 16 refers to the on-state resistance (Z2=120Ω) of one of the high breakdown voltage switches 234, and the symbol Z3 refers to the impedance of the wiring 52 from one of the high breakdown voltage switches 234 to the piezoelectric element 40. The symbol ZL is the impedance of one of the piezoelectric elements 40.

A case is assumed in which 1600 of the piezoelectric elements 40 with an electrostatic capacitance of 300 pF are installed on the head module 24, and a voltage of 33 V is applied to one of the piezoelectric elements 40 to supply a current of 5 mA. In a situation in which the control signal COM is supplied in parallel to all 1600 of the piezoelectric elements 40, it is necessary to allow a current of 8 A (5 mA×1600) to flow through the control wiring 724 and the ground wiring 728 within the FFC 70. Even in the situation described above, in order to suppress the fall in the voltage applied to the piezoelectric elements 40 to within 5% (1.65 V or lower) of the expected voltage (33 V), it is necessary to suppress the total value of the resistance components of the impedance Z1 of the control wiring 724 and the impedance Z4 of the ground wiring 728 to 0.21 Ω.

Now, a case will be considered in which the FFC 70 of a general-use type, which is formed from a wiring of a plurality of parallel wires (3 Ω/wire), each of which has a width of 700 μm and a thickness of 35 μm, the total length of which spans 4 m, is adopted for the connection between the control substrate 12 and the print head substrate 22. Since a sufficient current may not be transmitted by a wiring of only one wire, a collection (a bundle) of a wiring of a plurality of wires is used for the control wiring 724 and the ground wiring 728. In order to achieve the previously described conditions (Z1+Z4=0.21Ω) under the configuration described above, it is necessary to use a wiring of 21 wires of the FFC 70 for the control wiring 724 and to use a wiring of 42 wires for the ground wiring 728 (a total of 63 wires). For example, in a configuration in which the control signals COM of two systems are supplied from the control substrate 12 to the print head substrate 22 and selectively supplied to the piezoelectric elements 40, since it is necessary to use the control wiring 724 of 42 wires (21 wires×2 systems) for the transmission of the control signal COM, it is necessary to use the FFC 70 with a wiring of 84 wires.

Figure 17:
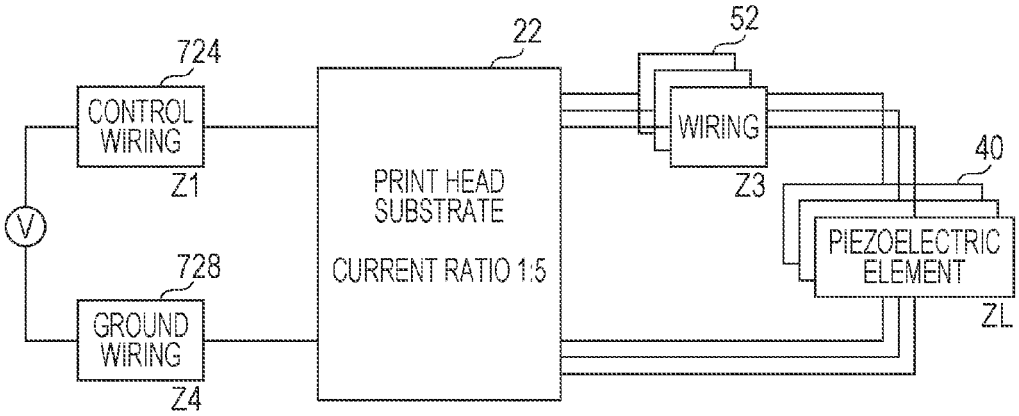
FIG. 17 is a schematic diagram for illustrating the effect of the embodiment compared with the comparative example.

On the other hand, in this embodiment, the transfer of charges between the auxiliary power supply unit 50 and the piezoelectric elements 40 is executed on the print head substrate 22. FIG. 17 is a schematic diagram modeling the current path of this embodiment. The element drive unit 240 and the auxiliary power supply unit 50 of the print head substrate 22 generate a current (a charge) that is higher than the current supplied from the FFC 70 and use the generated current for driving the piezoelectric elements 40. Specifically, a case is considered in which a current, which is five times the current supplied from the FFC 70, is generated by the print head substrate 22 (a current ratio of 1:5).

As described earlier in the comparative example, in a situation in which a current of 5 mA is supplied to 1600 of the piezoelectric elements 40 (a situation in which a total current of 8 A is necessary), it is necessary to allow a current of 1.6 A (8 A/5) to flow through the control wiring 724 and the ground wiring 728. In a situation in which a current of 1.6 A flows through the control wiring 724 and the ground wiring 728, in order to suppress a fall in the voltage between the control wiring 724 and the ground wiring 728 to approximately 2 V, it is sufficient to use a wiring of approximately 4 to 5 wires for each of the control wiring 724 and the ground wiring 728 in the FFC 70. In other words, in contrast to the comparative example in which a wiring of 84 wires is necessary, in this embodiment, a total number of wires necessary in the wiring for the transmission of the control signal COM and the ground voltage G is from 8 wires to 10 wires. Accordingly, there is a merit in that the number of connection points between each of the control substrate 12 and the print head substrate 22 and the FFC 70 is reduced.

As can be understood from the example described above, according to this embodiment, each of the piezoelectric elements 40 is driven by the transfer of charges between the auxiliary power supply unit 50 on the print head substrate 22 and each of the piezoelectric elements 40. Therefore, in principle, load fluctuation does not occur in the control wiring 724 or the ground wiring 728; thus, the current amount of the control signal COM to be transmitted by the FFC 70 and the fluctuation amount of the current are decreased. Accordingly, the power loss on the FFC 70 is greatly reduced in comparison to the comparative example; thus, it is possible to supply a control signal of an expected waveform to each of the piezoelectric elements 40 in a stable and highly precise manner regardless of the total number of the piezoelectric elements 40, which are the driving target. In other words, according to this embodiment, there is a merit in that it is possible to suppress a reduction in the print quality caused by power loss on the FFC 70. Note that, in the comparative example, since the drive load differs according to the total number (the number of nozzles) of the piezoelectric elements 40 of the print head 20, for example, it is necessary to carry out the evaluation and testing of the drive state of each of the piezoelectric elements 40, and the waveform correction and the like of the control signal separately for each type of the print head 20, in which the total number of the piezoelectric elements 40 differs. On the other hand, since load fluctuation does not occur in this embodiment, there is also a merit in that it is not necessary to carry out the evaluation and testing of the drive states of the piezoelectric elements 40, and the waveform correction and the like of the control signal separately for each type (for each total number of the piezoelectric elements 40) of the print head 20 (consequently, the manufacturing cost of the printing apparatus 100 is also reduced). Electromagnetic Interference (EMI) is also effectively suppressed by reducing the current fluctuation on the FFC 70. Accordingly, the structure for counteracting EMI, which is a problem in the comparative example, (for example, a ferrite core) can be rendered unnecessary or simplified.

Since transistors, electrolyte capacitors and the like are necessary on a large scale for the voltage amplifier 192 and the current amplifier 194, which are necessary in the comparative example, a problem may arise in that the circuit scale and the number of parts increases. In this embodiment, there is a merit in that, since the voltage amplifier 192 and the current amplifier 194 are unnecessary on the control substrate 12, the circuit scale and the number of parts on the control substrate 12 are reduced. Note that, in a configuration in which a large scale circuit such as the one shown in the comparative example is implemented on the control substrate 12, it is difficult to realize the control substrate 12 with a single circuit substrate; thus, it may become necessary to realize the control substrate 12 using a plurality of circuit substrates, and to electrically connect the circuit substrates to one another. In this embodiment, since the circuit scale on the control substrate 12 is minimized, it is possible to sufficiently realize the control substrate 12 using a single circuit substrate. In addition, in the comparative example, since the amount of heat output by the circuits on the control substrate 12 is great, a structure for heat radiation (such as a fan or fins) is necessary, and there is a problem in that the structure becomes complicated. Since it is not necessary to generate a large current on the control substrate 12, in this embodiment, there is also a merit in that the amount of heat output by the control substrate 12 is reduced in comparison to the comparative example. Note that, in this embodiment, while the amount of heat output on the control substrate 12 is reduced, the amount of heat output on the print head substrate 22 is increased in comparison with the comparative example. However, it is possible to effectively use the heat generated on the print head substrate 22 to heat the ink within the print head 20, for example, in order to reduce the viscosity thereof. In other words, there is a merit to outputting heat on the print head substrate 22 in comparison to outputting heat on the control substrate 12.

Note that the configuration of the circuit, which is installed on the print head substrate 22 and charges or discharges the piezoelectric elements 40 according to a control signal COM, is arbitrary. For example, it is possible to install various amplifiers (such as AB class and D class) that amplify the control signal COM, which is supplied from the control substrate 12, and a selection unit that selectively supplies the control signal COM, after the control signal COM undergoes amplification, to each of the piezoelectric elements on the print head substrate 22 instead of the elements (the voltage amplifier 210, the selection unit 230, the head control unit 220, the element drive unit 240, and the auxiliary power supply unit 50) on the print head substrate 22, as exemplified in the embodiment described above.

Application and Modification Examples

The invention is not limited to the embodiments described above; for example, various applications and modifications as described below are possible. Furthermore, the forms of the applications and modifications described below can be arbitrarily selected, or a plurality thereof can be appropriately combined.

Negative Feedback Control

Figure 18:
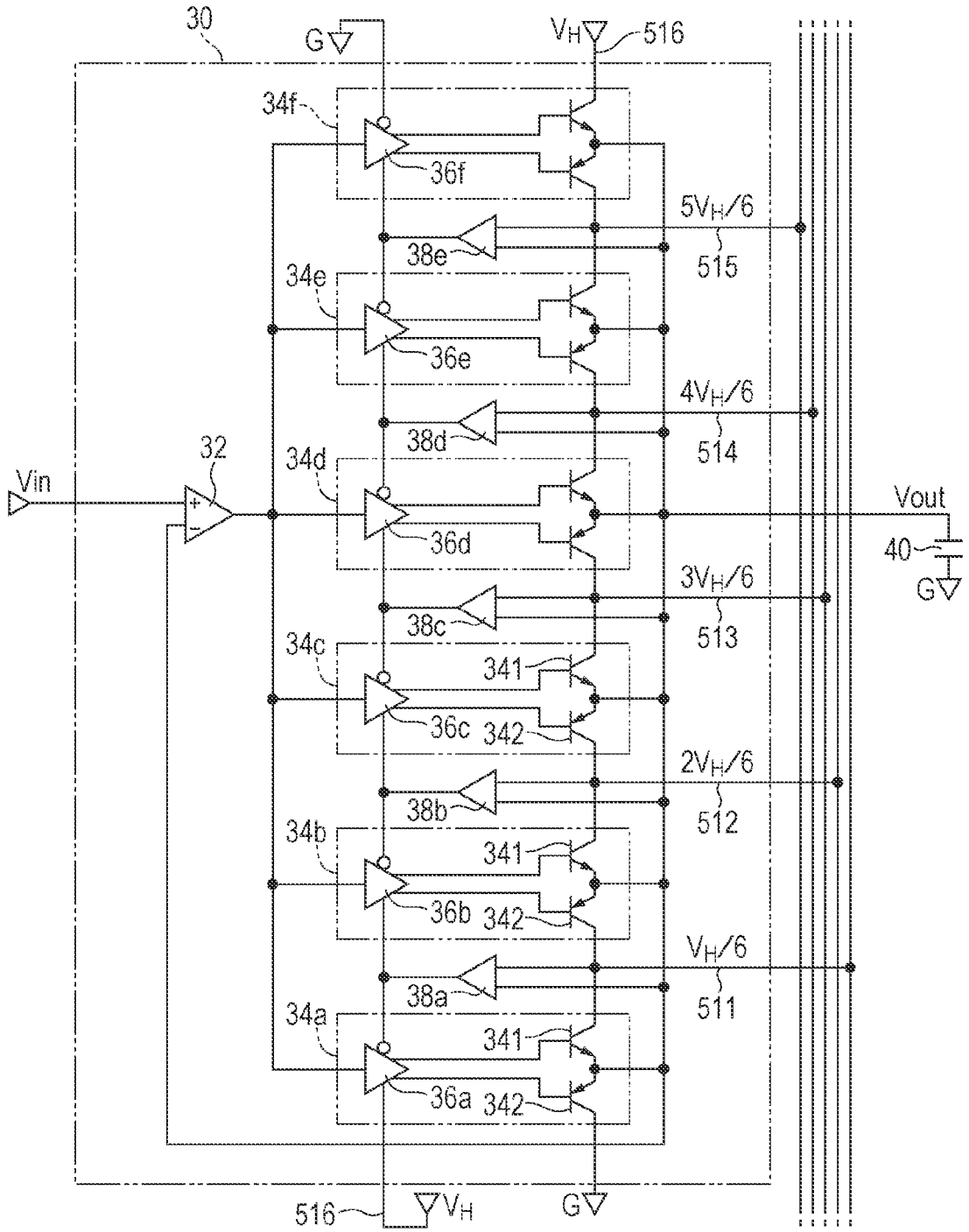
FIG. 18 is a diagram showing a configuration example of an application example of the driver.

FIG. 18 is a diagram showing an example of the configuration of the driver 30 according to an (a first) application example of the embodiment. As shown in FIG. 18, in this application example, a configuration is adopted in which the voltage Vout of the first terminal of the piezoelectric element 40 returns to the input terminal (−) of the operational amplifier 32 by negative feedback. In this configuration, when the voltage of the control signal Vin and the voltage Vout are different, the transistors 341 and 342 are controlled in the direction that removes the difference. Therefore, even when the response properties of the level shifters 36*a* to 36*f* and the transistors 341 and 342 are poor, it is possible to cause the voltage Vout to follow the control signal Vin in a relatively fast and precise manner.

Note that it is preferable to adopt a configuration in which it is possible to appropriately set the negative return amount to accommodate the properties of the level shifters 36*a* to 36*f* and the transistors 341 and 342. For example, in the example of FIG. 18, the operational amplifier 32 is configured to output a voltage that is obtained by subtracting the voltage Vout from the control signal Vin; however, the operational amplifier 32 may also be configured to multiply the obtained voltage by an appropriate factor and supply the result to the level shifters 36*a* to 36*f*.

Figure 19:
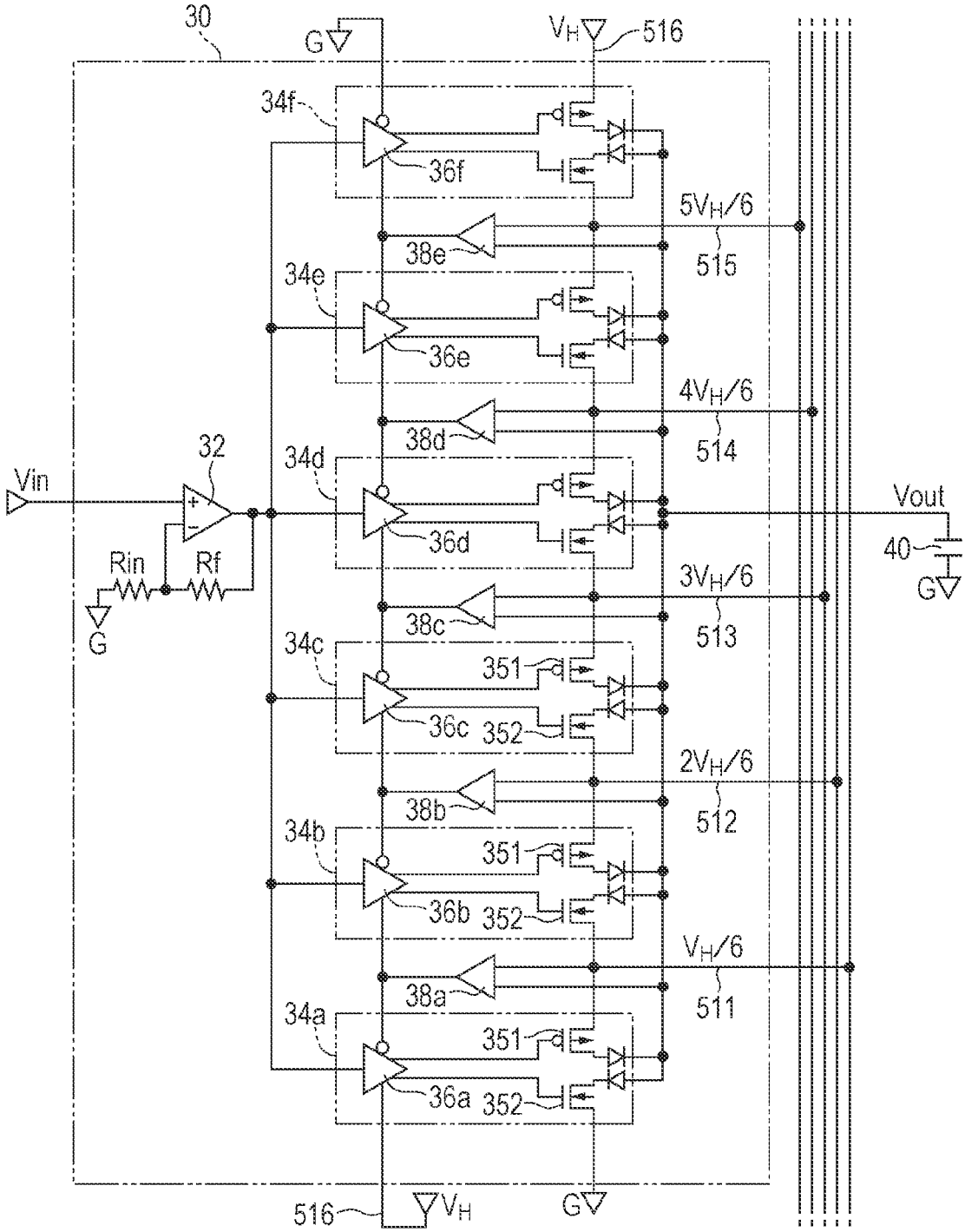
FIG. 19 is a diagram showing a configuration example of an application example of the driver.

FIG. 19 is a diagram showing an example of the configuration of the driver 30 according to another (a second) application example of the embodiment. In the driver 30 described in FIG. 4, the transistors 341 and 342 of the unit circuits 34*a* to 34*f* are bipolar transistors; however, in the (second) application example shown in FIG. 19, the transistors 341 and 342 are respectively P and N channel Metal-Oxide Semiconductor Field-Effect Transistors (MOSFETs) 351 and 352.

When using the MOSFETs 351 and 352, a diode for preventing a reverse current may be provided between each of the drain terminals and the first terminals of the piezoelectric elements 40. When the MOSFETs 351 and 352 are used, a configuration is adopted in which, if the level shifters 36*a* to 36*f* are in the enable state, the voltage of the control signal Vin is shifted in the negative direction by an amount that is equivalent to a threshold voltage as a predetermined value, and the shifted voltage is supplied to the gate terminal of the P channel MOSFET 351; whereas the voltage of the control signal Vin is shifted in the positive direction by an amount that is equivalent to the threshold voltage, and the shifted voltage is supplied to the gate terminal of the N channel MOSFET 352.

As shown in FIG. 18, when the MOSFETs 351 and 352 are used, a configuration may be applied in which the voltage Vout is returned by negative feedback.

Driving Target

In the embodiment, the piezoelectric element 40, which discharges an ink, is described as an example of the driving target of the driver 30. The invention is not limited to the driving target being the piezoelectric element 40, and is applicable to all loads that have a capacitive component.

Number of Unit Circuit Stages

In the embodiment, a configuration is adopted in which six stages of the unit circuits 34*a* to 34*f* are provided in low-to-high voltage order to correspond to two neighboring voltages, of the seven voltages; however, in the invention, the number of unit circuit stages is not limited thereto, and may also be two or more stages. Furthermore, the voltages need not necessarily be at equal intervals from one another.

Comparator

In the embodiment, a configuration is adopted in which, for example, if the determination result of the comparator 38*a* is false (the output signal is the L level), the first state is detected, and if the determination result of the comparator 38*a* is true (the output signal is the H level) and the determination result of the comparator 38*b* is false, the second state is detected. In other words, the configuration that detects the first state and the second state is not separated for each state, and a portion of the configuration overlaps; thus, the configuration detects from the first state to the sixth state using all the comparators 38*a* to 38*e*. The invention is not limited thereto, and a configuration may also be adopted in which each state is detected separately.

Disable State Level Shifter

In the embodiment, a configuration is adopted in which each of the level shifters 36*a* to 36*f* that are in the disable state supply the voltage zero to the base (the gate) terminal of the transistor 341 (351), and supply the voltage $V_H$ to the base (the gate) terminal of the transistor 342 (352); however, as long as the transistors 341 and 342 can be switched off, the invention is not limited to this configuration. For example, in the disable state, each of the level shifters 36*a* to 36*f* may supply an off signal, which is obtained by causing the voltage of the input control signal Vin to shift in the positive direction by a predetermined value, to the base (the gate) terminal of the transistor 341 (351), and may supply an off signal, which is obtained by causing the voltage of the control signal Vin to shift in the negative direction by a predetermined value, to the base (the gate) terminal of the transistor 342 (352).

According to this configuration, since a low breakdown voltage is sufficient for the transistors 341 (351) and 342 (352), it is possible to reduce the transistor size when forming the semiconductor substrate.

What is claimed is:

1. A capacitive load drive circuit, comprising:

a movable member;

pressure chambers, and capacitive elements, one provided for each of the pressure chambers;

a first circuit substrate, which is installed outside of the movable member, and on which is installed a control signal supply unit that generates control signals;

a second circuit substrate, which is installed on the movable member, and on which is installed a circuit that charges or discharges each of the capacitive elements according to the control signals; and a flexible flat cable, on which is formed a plurality of wirings including control wiring, which transmits the control signals from the first circuit substrate to the second circuit substrate, and a wiring, which supplies a power supply voltage and a ground voltage to the second circuit substrate, wherein a total path length of the plurality of wirings between the first circuit substrate and the second circuit substrate is shorter than the total path length of the wiring between the second circuit substrate and each of the capacitive elements.

2. The capacitive load drive circuit according to claim 1, wherein a booster circuit that generates a plurality of voltages, and connection path selecting units that selectively supply the plurality of voltages generated by the booster circuit to the capacitive elements according to the control signals are installed on the second circuit substrate.

3. The capacitive load drive circuit according to claim 2, wherein the connection path selecting units electrically connect the capacitive elements and the booster circuit using a first signal path or a second signal path according to the first signal path, to which a first voltage generated by the booster circuit is applied, the second signal path, to which the second voltage generated by the booster circuit that is higher than the first voltage is applied, voltages of the control signals, and the voltages held by the capacitive elements.

4. The capacitive load drive circuit according to claim 3, further comprising:

detection units, which are installed on the second circuit substrate, and detect whether or not the voltages held by the capacitive elements are lower than the first voltage, or, whether or not the voltages held by the capacitive elements are equal to or higher than the first voltage and lower than the second voltage.

5. The capacitive load drive circuit according to claim 3, wherein, in relation to the capacitive elements holding a voltage that is lower than the first voltage, the connection path selecting units control charges to be charged to the capacitive elements via the first signal path according to the voltages of the control signals, and wherein, in relation to the capacitive elements holding a voltage that is equal to or higher than the first voltage and lower than the second voltage, the connection path selecting units control the charges to be discharged from the capacitive elements via the first signal path, or, control the charges to be charged to the capacitive elements via the second signal path according to the voltages of the control signals.

6. The capacitive load drive circuit according to claim 1, wherein the movable member moves in a main scanning direction that intersects a sub-scanning direction in which a recording medium is transported.

* * * * *